US012138502B2

(12) United States Patent
Garcia

(10) Patent No.: US 12,138,502 B2
(45) **Date of Patent: *Nov. 12, 2024**

(54) BARBELL

(71) Applicant: Coulter Ventures, LLC., Columbus, OH (US)

(72) Inventor: Nicolas Garcia, Centerburg, OH (US)

(73) Assignee: Coulter Ventures, LLC., Columbus, OH (US)

( * ) Notice: Subject to any disclaimer, the term of this patent is extended or adjusted under 35 U.S.C. 154(b) by 75 days.

This patent is subject to a terminal disclaimer.

(21) Appl. No.: 17/986,427

(22) Filed: Nov. 14, 2022

(65) Prior Publication Data

US 2023/0277889 A1 Sep. 7, 2023

Related U.S. Application Data

(63) Continuation of application No. 17/033,150, filed on Sep. 25, 2020, now Pat. No. 11,497,955.

(60) Provisional application No. 62/983,135, filed on Feb. 28, 2020, provisional application No. 62/906,225, filed on Sep. 26, 2019.

(51) Int. Cl.
*A63B 21/072* (2006.01)

(52) U.S. Cl.
CPC ..... *A63B 21/0724* (2013.01); *A63B 21/0728* (2013.01); *A63B 2209/00* (2013.01)

(58) Field of Classification Search
CPC ..... A63B 21/0724; A63B 21/0728; A63B 2071/0063; A63B 2209/00; A63B 2225/30
See application file for complete search history.

(56) References Cited

U.S. PATENT DOCUMENTS

| | | | |
|---|---|---|---|
| 2,244,351 | A | 6/1941 | Venables |
| 2,470,815 | A | 5/1949 | Harvey |
| 3,606,410 | A | 9/1971 | Inserra |
| 3,790,922 | A | 2/1974 | Normann |
| 4,455,020 | A | 6/1984 | Schnell |
| 4,738,446 | A | 4/1988 | Miles |
| 5,839,996 | A | 11/1998 | Gooding |
| D425,949 | S | 5/2000 | Sandoval |
| D426,862 | S | 6/2000 | Sandoval |
| D428,630 | S | 7/2000 | Sandoval |

(Continued)

OTHER PUBLICATIONS

Feb. 9, 2024—(AU) 2nd Examination Report—App 2020355227.

(Continued)

*Primary Examiner* — Megan Anderson
(74) *Attorney, Agent, or Firm* — Banner & Witcoff, Ltd.

(57) ABSTRACT

A barbell includes a rotational body including a bar, a sleeve assembly having a sleeve with a bore, where a portion of the bar is received through the axial bore, a proximal bushing received in the bore and having a passage receiving the bar, a distal bushing received in the bore and having a cavity receiving a portion of the body. The proximal bushing has a first outer surface engaging the sleeve and a first inner surface engaging the bar within the passage. The distal bushing has a second outer surface engaging the sleeve and a second inner surface engaging the portion of the body within the cavity. The proximal bushing and the distal bushing permit the sleeve assembly to rotate around the body, and at least one of the first inner and outer surfaces and at least one of the second inner and outer surfaces are polymer surfaces.

25 Claims, 17 Drawing Sheets

(56) References Cited

U.S. PATENT DOCUMENTS

| | | | | |
|---|---|---|---|---|
| D433,468 | S | 11/2000 | Rojas et al. | |
| 6,875,161 | B1 | 4/2005 | Brice | |
| D583,883 | S | 12/2008 | Thomas | |
| 8,617,036 | B2 | 12/2013 | Chen | |
| 8,986,174 | B2 | 3/2015 | Lien | |
| D748,211 | S | 1/2016 | Gangemi et al. | |
| 9,314,661 | B1 * | 4/2016 | Chen | A63B 21/0724 |
| 9,522,298 | B2 | 12/2016 | Siemer | |
| 9,623,276 | B1 | 4/2017 | Deras | |
| D843,524 | S | 3/2019 | Henniger | |
| D862,617 | S | 10/2019 | Henniger et al. | |
| D909,176 | S | 2/2021 | Garcia | |
| D932,280 | S | 10/2021 | Garcia | |
| D954,161 | S | 6/2022 | Ameri | |
| 11,364,407 | B2 | 6/2022 | Jones et al. | |
| 11,497,955 | B2 * | 11/2022 | Garcia | A63B 21/0724 |
| D980,926 | S | 3/2023 | Ameri et al. | |
| 2006/0276314 | A1 | 12/2006 | Wilson et al. | |
| 2007/0197352 | A1 | 8/2007 | Charniga et al. | |
| 2008/0200316 | A1 | 8/2008 | Shillington | |
| 2009/0270233 | A1 | 10/2009 | Cao | |
| 2013/0165300 | A1 | 6/2013 | Richards | |
| 2013/0196830 | A1 | 8/2013 | Pfitzer | |
| 2014/0045661 | A1 | 2/2014 | Lien | |
| 2014/0274595 | A1 | 9/2014 | Patti | |
| 2016/0310782 | A1 | 10/2016 | Slaughter | |
| 2016/0325134 | A1 | 11/2016 | Riccoboni | |
| 2017/0319894 | A1 | 11/2017 | Ernst | |
| 2018/0272175 | A1 | 9/2018 | Henniger | |
| 2019/0184223 | A1 | 6/2019 | Seitzer | |
| 2019/0217147 | A1 | 7/2019 | Garcia et al. | |
| 2021/0178214 | A1 | 6/2021 | Garcia | |
| 2022/0161096 | A1 | 5/2022 | Berg | |
| 2023/0173325 | A1 | 6/2023 | Garcia | |

OTHER PUBLICATIONS

Product listing for American Barbell Cerakote Training Bar from https://web.archive.org/web/20170224030649/http://americanbarbell.com/products/american-barbell-cerakote-training-bar, dated Feb. 24, 2017.

Product listing for Rogue The Ohio Bar—Cerakote from https://www.roguefitness.com/the-ohio-bar-cerakote with irrelevant material redacted, dated Feb. 15, 2019, product known to be available prior to Apr. 23, 2018, but not on or prior to Apr. 23, 2017.

Olympic WI Bar by Rogue dated Apr. 18, 201. Found online [Apr. 18, 2019] https://www.roguefitness.com/rogue-olympic-wl-bar-cerakote?bvstate=pg:/ctr (Year:2014).

Pyros Bar by Rogue dated no date given. Found online [Apr. 18, 2019] https://www.roguefitness.com/rogue-pyrros-bar-25mm (Year:0).

Performance Training Bar by American Barbell dated Dec. 14, 2014. Found online [Apr. 18, 2019] https://americanbarbell.com/products/american-barbell-performance-training-bar (Year: 2014).

Performance Bearing Bar by American Barbell dated Dec. 17, 2014. Found online [Apr. 18, 2019] https://americanbarbell.com/products/american-barbell-performance-bearing-bar (Year: 2014).

29MM Boneyard Bars by Rogue dated no date given. Found online [Apr. 18, 2019] https://www.roguefitness.com/rogue-28mm-boneyard-bars (Year: 0).

IWF by Eleiko dated no date given. Found online [Apr. 18, 2019] https://www.eleiko.com/en/p/eleiko-iwf-weightlifting-training-bar-20-kg-men/14#gs.5oncat (Year: 0).

Vulcan by Vulcan dated no date given. Found online [Apr. 18, 2019] https://www.vulcanstrength.com/Men-s-professional-Olympic-Bar-p/vstb-m.htm (Year: 0).

Westside power bar 2 by Rogue dated Apr. 18, 2016. Found online [Apr. 18, 2019] https://www.roguefitness.com/rogue-westside-power-bar-2-0?bvstate=p. 2/ct:r (Year: 2016).

Grizzly Power Bar by American Barbell dated Dec. 13, 2017. Found online [Apr. 18, 2019] https://americanbarbell.com/products/grizzly-power-bar (Year: 2014).

Power Bar by American Barbell dated Mar. 18, 2015. Found online [Apr. 18, 2019] https://americanbarbell.com/products/american-barbell-power-bar (Year: 2015) <br class="minwidth empty">.

Elite Power Bar by American Barbell dated Nov. 6, 2015. Found online [Apr. 18, 2019] https://americanbarbell.com/products/american-barbell-training-bar-1 (Year: 2014).

Mammoth Bar by American barbell dated Sep. 23, 2015. Found online [Apr. 18, 2019] https://americanbarbell.com/products/american-barbell-ceramic-mammoth-bar (Year: 2015).

Mar. 10, 2020 (WO) International Search Report & Written Oppinion PCT/US2019/064237.

Screen capture of Rogue Elephant Bar Deadlift—Full Live Stream | Arnold Strongman Classic 2020, from <https://www.youtube.com/watch?v=CuYsT9GeUmc&feature=emb_rel_pause>, dated Mar. 7, 2020.

Dec. 22, 2020—(WO) ISR and WO—App PCT/US2020/052858.

Product listing for Rogue Freedom Bar from http://web.archive.org/web/20180704014252/https://www.roguefitness.com/cerakote-28-5-mm-freedom-bar, dated Jul. 4, 2018, accessed May 5, 2021.

Producting listing for Rogue Castro Bar—Bare Steel Barbell from http://web.archive.org/web/20140613135148/https://www.roguefitness.com/the-castro-bar tness.com/the-castro-bar, dated Jun. 13, 2014, accessed May 5, 2021.

Product listing for Rogue Operator Bar 3.0; From: http:/web.archive.org/web/20210225082909/https://www.roguefitness.com/rogue-operator-bar-cerakote; dated Jul. 23, 2018, accessed Jun. 29, 2021.

Product listing for Rogue 10KG Junior Bar; From: http://web.archive.org/web/20180720234027/https://www.roguefitness.com/rogue-10kg-junior-bar; dated Jun. 13, 2015, accessed Jun. 29, 2021.

Overview of materials for Polytetrafluoroethylene (PTFE), Extruded, retrieved Dec. 3, 2021, Matweb (Year: 2021).

Resin English Definition and Meaning, retrieved Dec. 27, 2021, Lexico (Year: 2021).

Mar. 10, 2023—(AU) Examination Report—App 2020355227.

* cited by examiner

BARBELL

CROSS-REFERENCE TO RELATED APPLICATIONS

This application is a continuation of, and claims priority to U.S. application Ser. No. 17/033,150, filed Sep. 25, 2020, which is a nonprovisional of, and claims priority to, U.S. Provisional Application No. 62/906,225, filed Sep. 26, 2019, and U.S. Provisional Application No. 62/983,135, filed Feb. 28, 2020, all of which prior applications are incorporated by reference herein in their entireties.

FIELD OF THE INVENTION

This disclosure relates to barbells, and more specifically to a barbell having polymer engaging structures positioned between a bar and sleeves of the barbell.

BRIEF SUMMARY

Aspects of the disclosure relate to a barbell that includes a bar having a first end portion and a second end portion, a first sleeve assembly including a first sleeve having a first axial bore with a first proximal bore portion, a first distal bore portion, and a first central bore portion extending between the first proximal bore portion and the first distal bore portion, where the first end portion of the bar is received through the first axial bore and extends through the first proximal bore portion and the first central bore portion to the first distal bore portion, a first proximal bushing received in the first proximal bore portion of the first sleeve, and a first distal bushing received in the first distal bore portion of the first sleeve. The first proximal bushing is fixed against axial movement with respect to the first sleeve assembly and has a first axial passage receiving the bar therethrough, where the first proximal bushing has a first outer surface engaging the first sleeve and a first inner surface engaging the bar within the first axial passage. The first distal bushing is fixed against axial movement with respect to the first sleeve assembly and has a first cavity. The barbell also includes a first barrel fixed to the first end portion of the bar, the first barrel having a cylindrical outer shape and received within the first cavity of the first distal bushing. The first distal bushing has a second outer surface engaging the first sleeve and a second inner surface engaging the first barrel within the first cavity. The first proximal bushing and the first distal bushing permit the first sleeve assembly to be freely rotatable around the bar and the first barrel, and the first outer surface and the first inner surface, the second outer surface, and the second inner surface are polymer surfaces.

According to one aspect, the bar further includes a first threaded projection extending outward from the first end portion. In one embodiment, the first barrel is fixed to the first end portion of the bar by a first fastener threaded onto the first threaded projection.

According to another aspect, the first axial bore has a first proximal opening and a first distal opening, and the first proximal bore portion extends inward from the proximal opening, and the first distal bore portion extends inward from the distal opening.

According to another aspect, the first sleeve assembly is freely rotatable with respect to the bar by the first proximal bushing rotating around the bar and the first distal bushing rotating around the first barrel.

According to another aspect, the first central bore portion has a first inner diameter that is smaller than the first proximal bore portion and the first distal bore portion.

According to a further aspect, the first barrel is fixed against axial movement with respect to the first distal bushing and against axial movement with respect to the bar, such that the bar is thereby also fixed against axial movement with respect to the first distal bushing.

According to yet another aspect, the first outer surface, the first inner surface, the second outer surface, and the second inner surface are formed of a same polymer material.

According to a still further aspect, the first axial bore has a first proximal opening and a first distal opening, and the first proximal bore portion is proximate to the proximal opening, and the first distal bore portion is proximate to the first distal opening.

According to an additional aspect, the barbell also includes a second sleeve assembly including a second sleeve having a second axial bore with a second proximal bore portion, a second distal bore portion, and a second central bore portion extending between the second proximal bore portion and the second distal bore portion, wherein the second end portion of the bar is received through the second axial bore and extends through the second proximal bore portion and the second central bore portion to the second distal bore portion, a second proximal bushing received in the second proximal bore portion of the second sleeve, and a second distal bushing received in the second distal bore portion of the second sleeve. The second proximal bushing is fixed against axial movement with respect to the second sleeve assembly and has a second axial passage receiving the bar therethrough, where the second proximal bushing has a third outer surface engaging the second sleeve and a third inner surface engaging the bar within the second axial passage. The second distal bushing is fixed against axial movement with respect to the second sleeve assembly and has a second cavity. The barbell further includes a second barrel fixed to the second end portion of the bar, the second barrel having a cylindrical outer shape and received within the second cavity of the second distal bushing. The second distal bushing has a fourth outer surface engaging the second sleeve and a fourth inner surface engaging the second barrel within the second cavity. The second sleeve assembly is freely rotatable with respect to the bar by the second proximal bushing rotating around the bar and the second distal bushing rotating around the second barrel, and the third outer surface, the third inner surface, the fourth outer surface, and the fourth inner surface are polymer surfaces.

According to another aspect, the first distal bushing includes a first bushing portion and a second bushing portion in abutting contact with each other. The first bushing portion has a first cylindrical wall with a first annular flange extending inward from the first cylindrical wall to define a first aperture at a proximal end of the first distal bushing, and the second bushing portion is positioned at a distal end of the first distal bushing. The first and second bushing portions combine to define the first cavity of the first distal bushing. In one configuration, the second bushing portion has a second cylindrical wall with a second annular flange extending inward from the second cylindrical wall to define a second aperture at the distal end of the first distal bushing, and the first cylindrical wall of the first bushing portion and the second cylindrical wall of the second bushing portion combine to define the second outer surface and the second inner surface, and to further define the first cavity as a cylindrical cavity. In another configuration, the first barrel engages the first annular flange and further engages the second bushing portion to resist axial movement of the first barrel with respect to the first distal bushing. In a further configuration, the second bushing portion is identical to the first bushing portion and is positioned in reverse orientation relative to the first bushing portion.

According to another aspect, the barbell includes a retaining member engaging a distal end of the first distal bushing to retain the first distal bushing in the first distal bore portion.

According to an additional aspect, the first sleeve has a first groove within the first proximal bore portion, and the first proximal bushing has a first engaging surface received within the first groove and engaging a surface of the first groove to retain the first proximal bushing within the first proximal bore portion.

According to yet another aspect, the polymer surfaces are all formed of polymer materials having a durometer hardness of 50 Shore A to 100 Shore A.

Additional aspects of the disclosure relate to a barbell that includes a first rotational body including a bar having a first end portion and a second end portion, a second rotational body mounted on the first end portion of the bar, a first rotational engagement structure connecting the first rotational body to the second rotational body to permit the second rotational body to be freely rotatable with respect to the first rotational body, such that the first rotational engagement structure constitutes all structures engaging both the first rotational body and the second rotational body, a third rotational body mounted on the second end portion of the bar, and a second rotational engagement structure connecting the first rotational body to the third rotational body to permit the third rotational body to be freely rotatable with respect to the first rotational body, such that the second rotational engagement structure constitutes all structures engaging both the first rotational body and the third rotational body. The second rotational body includes a first sleeve having a first bore receiving the first end portion of the bar, and the third rotational body includes a second sleeve having a second bore receiving the second end portion of the bar. All surfaces of the first rotational engagement structure engaging at least one of the first rotational body and the second rotational body and all surfaces of the second rotational engagement structure engaging at least one of the first rotational body and the third rotational body are formed of one or more polymer materials.

According to one aspect, the first rotational engagement structure includes at least a first bushing having a first surface engaging the first rotational body and a second surface engaging the second rotational body to permit rotation of the second rotational body relative to the first rotational body, and at least one of the first and second surfaces are formed of the one or more polymer materials. Additionally, the second rotational engagement structure includes at least a second bushing having a third surface engaging the first rotational body and a fourth surface engaging the third rotational body to permit rotation of the third rotational body relative to the first rotational body, and at least one of the third and fourth surfaces are formed of the one or more polymer materials. In one configuration, the first bushing is a first distal bushing located proximate to a distal end of the second rotational body and the first end portion of the first rotational body, and the second bushing is a second distal bushing located proximate to a distal end of the third rotational body and the second end portion of the first rotational body. In another configuration, the first bushing is a first proximal bushing located proximate to a proximal end of the second rotational body and spaced from the first end portion of the first rotational body, and the second bushing is a second proximal bushing located proximate to a proximal end of the third rotational body and spaced from the second end portion of the first rotational body. In a further configuration, the first rotational body includes a first cylindrical barrel connected to the first end portion of the bar and a second cylindrical barrel connected to the second end portion of the bar, the first and second cylindrical barrels having larger diameters than the bar. In this configuration, the first cylindrical barrel is engaged with the second surface of the first bushing to permit rotation of the second rotational body relative to the first cylindrical barrel, and the second cylindrical barrel is engaged with the fourth surface of the second bushing to permit rotation of the third rotational body relative to the second cylindrical barrel.

According to another aspect, the first rotational engagement structure includes at least a first proximal bushing formed of a first polymer material of the one or more polymer materials and a first distal bushing formed of a second polymer material of the one or more polymer materials, the first proximal bushing and the first distal bushing engaging the first rotational body and the second rotational body to permit rotation of the second rotational body relative to the first rotational body. Additionally, the second rotational engagement structure includes at least a second proximal bushing formed of a third polymer material of the one or more polymer materials and a second distal bushing formed of a fourth polymer material of the one or more polymer materials, the second proximal bushing and the second distal bushing engaging the first rotational body and the third rotational body to permit rotation of the third rotational body relative to the first rotational body.

According to a further aspect, the first rotational engagement structure includes a first rotor fixed to the first end portion of the bar and having a first cylindrical outer surface engaging an inner surface of the first bore to permit rotation of the second rotational body relative to the first rotational body, and the second rotational engagement structure includes a second rotor fixed to the second end portion of the bar and having a second cylindrical outer surface engaging an inner surface of the second bore to permit rotation of the third rotational body relative to the first rotational body.

According to yet another aspect, the first polymer material, the second polymer material, the third polymer material, and the fourth polymer material are the same.

According to a still further aspect, the one or more polymer materials each have a durometer hardness of 50 Shore A to 100 Shore A.

Further aspects of the disclosure relate to a barbell including a bar having a first end portion and a second end portion, a first sleeve assembly comprising a first sleeve having a first axial bore with a first proximal opening and a first distal opening, the first axial bore having a first proximal bore portion extending inward from the proximal opening, a first distal bore portion extending inward from the distal opening, and a first central bore portion extending between the first proximal bore portion and the first distal bore portion, a first proximal bushing received in the first proximal bore portion of the first sleeve, a first distal bushing received in the first distal bore portion of the first sleeve, a first barrel having a cylindrical outer shape and received within the first cylindrical cavity of the first distal bushing, a second sleeve assembly comprising a second sleeve having a second axial bore with a second proximal opening and a second distal opening, the second axial bore having a second proximal bore portion extending inward from the proximal opening, a second distal bore portion extending inward from the distal opening, and a second central bore portion extending between the second proximal bore portion and the second distal bore portion, a second proximal bushing received in the second proximal bore portion of the second sleeve, a second distal bushing received in the second distal bore portion of the second sleeve, and a second barrel having a cylindrical outer shape and received within the second cylindrical cavity of the second distal bushing. The bar has a first threaded projection extending outward from the first end portion and a second threaded projection extending outward from the second end portion. The first central bore portion has a first inner diameter that is smaller than the first proximal bore portion and the first distal bore portion, and the first end portion of the bar is received through the first axial bore and extends through the first proximal bore portion and the first central bore portion to the first distal bore portion. The second central bore portion has a second inner diameter that is smaller than the second proximal bore portion and the second distal bore portion, and the second end portion of the bar is received through the second axial bore and extends through the second proximal bore portion and the second central bore portion to the second distal bore portion. The first proximal bushing is fixed against axial movement with respect to the first sleeve assembly and has a first axial passage receiving the bar therethrough, and the first proximal bushing is formed of a first polymer material. The first distal bushing is fixed against axial movement with respect to the first sleeve assembly and has a first cylindrical cavity and a first aperture extending to the first inner cavity and receiving the first end portion of the bar therethrough, and the first distal bushing is formed of a second polymer material. The second proximal bushing is received in the second proximal bore portion of the second sleeve and fixed against axial movement with respect to the second sleeve assembly and has a second axial passage receiving the bar therethrough, and the second proximal bushing is formed of a third polymer material. The second distal bushing is received in the second distal bore portion of the second sleeve and fixed against axial movement with respect to the second sleeve assembly and has a second cylindrical cavity and a second aperture extending to the second inner cavity and receiving the second end portion of the bar therethrough, and the second distal bushing is formed of a fourth polymer material. The first barrel is fixed to the first end portion of the bar by a first fastener threaded onto the first threaded projection, and the first barrel is fixed against axial movement with respect to the first distal bushing and is fixed against axial and rotational movement with respect to the bar. The second barrel is fixed to the second end portion of the bar by a second fastener threaded onto the second threaded projection, and the second barrel is fixed against axial movement with respect to the second distal bushing and is fixed against axial and rotational movement with respect to the bar. The first sleeve assembly is freely rotatable with respect to the bar by the first proximal bushing rotating around the bar and the first distal bushing rotating around the first barrel, and the second sleeve assembly is freely rotatable with respect to the bar by the second proximal bushing rotating around the bar and the second distal bushing rotating around the second barrel.

According to one aspect, the first proximal bushing is formed entirely of the first polymer material, the first distal bushing is formed entirely of the second polymer material, the second proximal bushing is formed entirely of the third polymer material, and the second distal bushing is formed entirely of the fourth polymer material.

According to another aspect, the first polymer material, the second polymer material, the third polymer material, and the fourth polymer material are the same.

According to a further aspect, the first distal bushing includes a first bushing portion and a second bushing portion in abutting contact with each other, the first bushing portion having a first cylindrical wall with a first annular flange extending inward from the first cylindrical wall to define a first aperture at a proximal end of the first distal bushing, and the second bushing portion is positioned at a distal end of the first distal bushing, such that the first and second bushing portions combine to define the first cylindrical cavity of the first distal bushing. In one configuration, the second bushing portion has a second cylindrical wall with a second annular flange extending inward from the second cylindrical wall to define a second aperture at the distal end of the first distal bushing, and the first cylindrical wall of the first bushing portion and the second cylindrical wall of the second bushing portion combine to define the first cylindrical cavity. In another configuration, the second bushing portion is identical to the first bushing portion and is positioned in reverse orientation relative to the first bushing portion, and the first bushing portion and the second bushing portion are both formed of the second polymer material.

According to yet another aspect, the first sleeve has a first groove within the first proximal bore portion, and the first proximal bushing has an annular shoulder defining a first engaging surface received within the first groove and engaging a first surface of the first groove to retain the first proximal bushing within the first proximal bore portion and to resist axial movement of the first proximal bushing toward the first proximal opening with respect to the first sleeve. A distal end of the first proximal bushing engages a second surface of the first groove to resist axial movement of the first proximal bushing toward the first distal opening with respect to the first sleeve.

According to a still further aspect, the first polymer material, the second polymer material, the third polymer material, and the fourth polymer material each have a durometer hardness of 50 Shore A to 100 Shore A.

Still further aspects of the disclosure relate to a barbell that includes a bar assembly including a bar having a first end portion and a second end portion, a first sleeve assembly including a first sleeve having a first axial bore with a first proximal opening, a first proximal bore portion extending inward from the first proximal opening, a first distal bore portion, and a first central bore portion extending between the first proximal bore portion and the first distal bore portion, and a first proximal bushing received in the first proximal bore portion of the first sleeve and fixed against axial movement with respect to the first sleeve assembly. The first end portion of the bar is received through the first axial bore and extends through the first proximal bore portion and the first central bore portion to the first distal bore portion, the first central bore portion has a first inner diameter that is smaller than the first proximal bore portion, and the first proximal bore portion has a first groove spaced distally from the first proximal opening. The first proximal bushing has a first axial passage receiving the bar therethrough, a first outer surface engaging the first sleeve, and a first inner surface engaging the bar within the first axial passage. The first proximal bushing further has a first engaging surface received within the first groove and engaging a first surface of the first groove to retain the first proximal bushing within the first proximal bore portion and to resist axial movement of the first proximal bushing toward the first proximal opening with respect to the first sleeve. The first proximal bushing permits the first sleeve assembly to be freely rotatable with respect to the bar, and the first outer surface and the first inner surface are polymer surfaces.

According to one aspect, the first groove is an annular groove, and the first proximal bushing has an annular shoulder defining the first engaging surface.

According to another aspect, the first sleeve assembly is freely rotatable with respect to the bar by the first proximal bushing rotating around the bar.

According to a further aspect, a distal end of the first proximal bushing engages a second surface of the first groove to resist axial movement of the first proximal bushing toward the first distal bore portion with respect to the first sleeve.

According to yet another aspect, the barbell also includes a first distal bushing received in the first distal bore portion of the first sleeve and having a first cavity receiving a portion of the bar assembly, the first distal bushing further having second outer surface engaging the first sleeve and a second inner surface engaging the portion of the bar assembly. The first sleeve assembly is further freely rotatable with respect to the bar by the first distal bushing rotating around the portion of the bar assembly, and the second outer surface and the second inner surface are polymer surfaces.

Yet additional aspects of the disclosure relate to a barbell that includes a bar having a first end portion and a second end portion, a first sleeve assembly including a first sleeve having a first axial bore with a first proximal bore portion, a first distal bore portion, and a first central bore portion extending between the first proximal bore portion and the first distal bore portion, a first distal bushing received in the first distal bore portion of the first sleeve and fixed against axial movement with respect to the first sleeve assembly, the first distal bushing having a first cylindrical cavity and a first aperture extending to the first cavity, and a first barrel removably fixed to the first end portion of the bar, the first barrel having a cylindrical outer shape and received within the first cavity of the first distal bushing. The first end portion of the bar is received through the first axial bore and extends through the first proximal bore portion and the first central bore portion to the first distal bore portion, the first central bore portion having a first inner diameter that is smaller than the first distal bore portion. The first barrel has a larger outer diameter than the bar, and the first distal bushing has a first outer surface engaging the first sleeve and a second inner surface defining the first cylindrical cavity and engaging the first barrel within the first cylindrical cavity. The first distal bushing further engages the first barrel to fix the first barrel against axial movement with respect to the first distal bushing, and the first sleeve assembly is freely rotatable with respect to the bar by the first distal bushing rotating around the first barrel. The first outer surface and the first inner surface are polymer surfaces.

According to one aspect, the bar further includes a first threaded projection extending outward from the first end portion, and the first barrel is fixed to the first end portion of the bar by a first fastener threaded onto the first threaded projection.

According to another aspect, the first distal bushing includes a first bushing portion and a second bushing portion in abutting contact with each other, the first bushing portion having a first cylindrical wall with a first annular flange extending inward from the first cylindrical wall to define a first aperture at a proximal end of the first distal bushing. The second bushing portion is positioned at a distal end of the first distal bushing, and the first and second bushing portions combine to define the first cylindrical cavity of the first distal bushing. In one configuration, the second bushing portion has a second cylindrical wall with a second annular flange extending inward from the second cylindrical wall to define a second aperture at the distal end of the first distal bushing. In this configuration, the first cylindrical wall of the first bushing portion and the second cylindrical wall of the second bushing portion combine to define the first outer surface and the first inner surface, and to further define the first cylindrical cavity. In another configuration, the first barrel engages the first annular flange and further engages the second bushing portion to resist axial movement of the first barrel with respect to the first distal bushing. In a further configuration, the second bushing portion is identical to the first bushing portion and is positioned in reverse orientation relative to the first bushing portion.

Other aspects of the disclosure relate to a barbell that includes a first rotational body including a bar having a first end portion and a second end portion, a second rotational body mounted on the first end portion of the bar and including a first sleeve having a first bore receiving the first end portion of the bar, and a first rotational engagement structure connecting the first rotational body to the second rotational body to permit the second rotational body to be freely rotatable with respect to the first rotational body. The first rotational body, the second rotational body, and the first rotational engagement structure have a plurality of surface pairs engaging each other in surface-to-surface engagement with clearances greater than 0.001 inch, and each of the plurality of surface pairs engaging each other in surface-to-surface engagement with clearances greater than 0.001 inch includes at least one polymer surface.

According to one aspect, the first rotational engagement structure includes at least a first bushing engaging the first rotational body to form a first surface pair of the plurality of surface pairs engaging each other in surface-to-surface engagement with clearances greater than 0.001 inch and engaging the second rotational body to form a second surface pair of the plurality of surface pairs engaging each other in surface-to-surface engagement with clearances greater than 0.001 inch. At least one surface of the first surface pair and at least one surface of the second surface pair are polymer surfaces.

According to another aspect, the first rotational engagement structure includes at least a first proximal bushing and a first distal bushing. The first proximal bushing has a first surface engaging the first rotational body to form a first surface pair of the plurality of surface pairs engaging each other in surface-to-surface engagement with clearances greater than 0.001 inch, and a second surface engaging the second rotational body to form a first surface pair of the plurality of surface pairs engaging each other in surface-to-surface engagement with clearances greater than 0.001 inch. The first distal bushing has a third surface engaging the first rotational body to form a third surface pair of the plurality of surface pairs engaging each other in surface-to-surface engagement with clearances greater than 0.001 inch, and a fourth surface engaging the second rotational body to form a fourth surface pair of the plurality of surface pairs engaging each other in surface-to-surface engagement with clearances greater than 0.001 inch. The first surface, the second surface, the third surface, and the fourth surface are polymer surfaces.

According to a further aspect, each of the polymer surfaces is formed of a polymer material having a durometer hardness of 50 Shore A to 100 Shore A. In one configuration, the polymer materials of all of the polymer surfaces are the same.

According to yet another aspect, the barbell also includes a third rotational body mounted on the second end portion of the bar, the third rotational body including a second sleeve having a second bore receiving the second end portion of the bar, and a second rotational engagement structure connecting the first rotational body to the third rotational body to permit the third rotational body to be freely rotatable with respect to the first rotational body. The first rotational body, the third rotational body, and the second rotational engagement structure have a second plurality of surface pairs engaging each other in surface-to-surface engagement with clearances greater than 0.001 inch, and wherein each of the second plurality of surface pairs engaging each other in surface-to-surface engagement with clearances greater than 0.001 inch includes at least one polymer surface.

According to a still further aspect, the first rotational engagement structure includes a first rotor fixed to the first end portion of the bar and having a first cylindrical outer surface engaging an inner surface of the first bore to permit rotation of the second rotational body relative to the first rotational body. The first cylindrical outer surface and the inner surface of the first bore form a first surface pair of the plurality of surface pairs engaging each other in surface-to-surface engagement with clearances greater than 0.001 inch, and at least one of the first cylindrical outer surface and the inner surface of the first bore is a polymer surface.

Other aspects of the disclosure relate to a barbell that includes a bar having a first end portion and a second end portion, a first sleeve assembly including a first sleeve having a first axial bore with a first proximal bore portion, a first distal bore portion, and a first central bore portion extending between the first proximal bore portion and the first distal bore portion, a first proximal bushing received in the first proximal bore portion of the first sleeve and fixed against axial movement with respect to the first sleeve assembly, and a first rotor received in the first distal bore portion of the first sleeve and fixed against axial movement with respect to the first sleeve assembly, the first rotor fixed to the first end portion of the bar. The first end portion of the bar is received through the first axial bore and extends through the first proximal bore portion and the first central bore portion to the first distal bore portion. The first proximal bushing has a first axial passage receiving the bar therethrough and a first outer surface engaging the first sleeve and a first inner surface engaging the bar within the first axial passage. The first rotor has a cylindrical outer surface engaging the first sleeve, where the cylindrical outer surface is a polymer surface, and the first proximal bushing and the first rotor permit the first sleeve assembly to be freely rotatable around the bar and the first barrel.

Additional aspects of the disclosure relate to a barbell that includes a first rotational body including a bar having a first end portion and a second end portion, a first sleeve assembly including a first sleeve having a first axial bore with a first proximal bore portion and a first distal bore portion, a first proximal bushing received in the first proximal bore portion of the first sleeve, and a first distal bushing received in the first distal bore portion of the first sleeve and having a first cavity receiving a portion of the first rotational body located at the first end portion of the bar. The first end portion of the bar is received through the first axial bore and extends through the first proximal bore portion to the first distal bore portion. The first proximal bushing has a first axial passage receiving the bar therethrough and a first outer surface engaging the first sleeve and a first inner surface engaging the bar within the first axial passage. The first distal bushing has a second outer surface engaging the first sleeve and a second inner surface engaging the portion of the first rotational body within the first cavity. The first proximal bushing and the first distal bushing permit the first sleeve assembly to be freely rotatable around the first rotational body. At least one of the first outer surface and the first inner surface of the first proximal bushing and at least one of the second outer surface and the second inner surface of the first distal bushing are polymer surfaces.

Other aspects of the disclosure relate to a bushing that includes a cylindrical bushing body having cylindrical inner and outer surfaces, with the inner surface defining an axial passage through the bushing body, where the bushing body is configured to be inserted into a bore, and an engaging surface extending outward from the outer surface of the bushing body. The engaging surface is configured to be received within a groove in the bore when the bushing body is inserted into the bore, such that the engaging surface is configured to engage a surface of the groove to retain the bushing body within the bore.

According to one aspect, at least the inner surface and the outer surface are polymer surfaces. According to another aspect, the bushing is formed of a polymer material.

Other aspects of the disclosure relate to a bushing that includes a first bushing portion having a first cylindrical wall surrounding a first cavity, with a first annular flange extending inward from the first cylindrical wall to define a first aperture, and a second bushing portion having a second cylindrical wall surrounding a second cavity, with a second annular flange extending inward from the second cylindrical wall to define a second aperture. The second bushing portion is in abutting contact with the first bushing portion, such that the second bushing portion is positioned distally with respect to the first bushing portion, wherein the second annular flange is positioned at a distal end of the bushing, and the first annular flange is positioned at a proximal end of the bushing. The first cavity and the second cavity combine to define an inner cavity.

According to one aspect, the second bushing portion is identical to the first bushing portion and is positioned in reverse orientation relative to the first bushing portion.

According to another aspect, the bushing has an inner surface surrounding the cavity and an outer surface opposite the inner surface, and the inner surface and the outer surface are polymer surfaces. According to a further aspect, the bushing is formed of a polymer material.

Still other aspects of the disclosure relate to a method of assembling a barbell according to any configuration, aspect, or embodiment described above, including inserting a proximal bushing and/or a distal bushing into a bore of a sleeve, inserting a bar through the bore, and connecting the sleeve to the bar using a connecting structure, where the connecting structure and the proximal and/or distal bushings permit the bar to rotate with respect to the bar.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
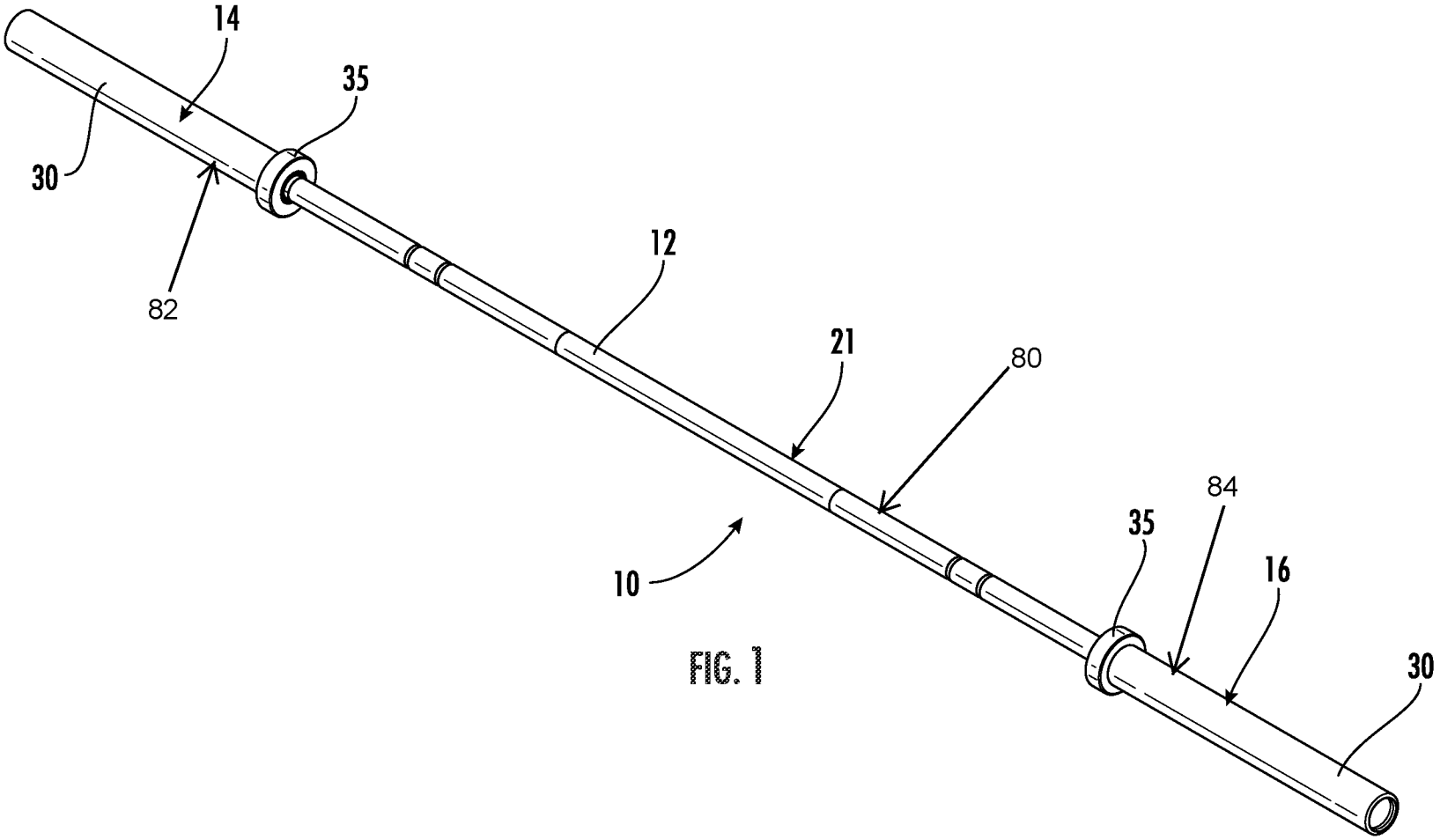
FIG. 1 is a perspective view of one embodiment of a barbell according to aspects of the present disclosure.
Figure 2:
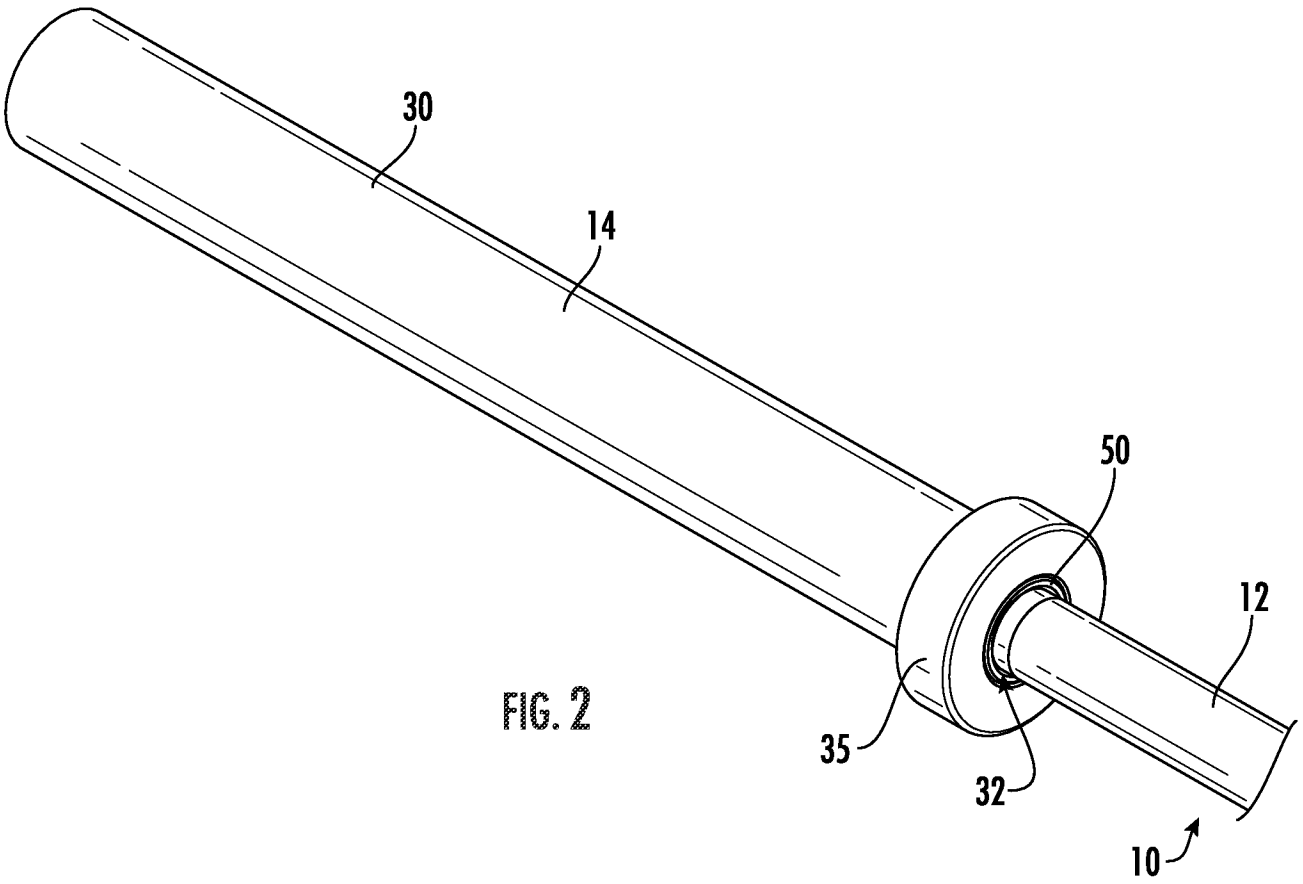
FIG. 2 is a perspective view of a first sleeve assembly of the barbell of FIG. 1.
Figure 3:
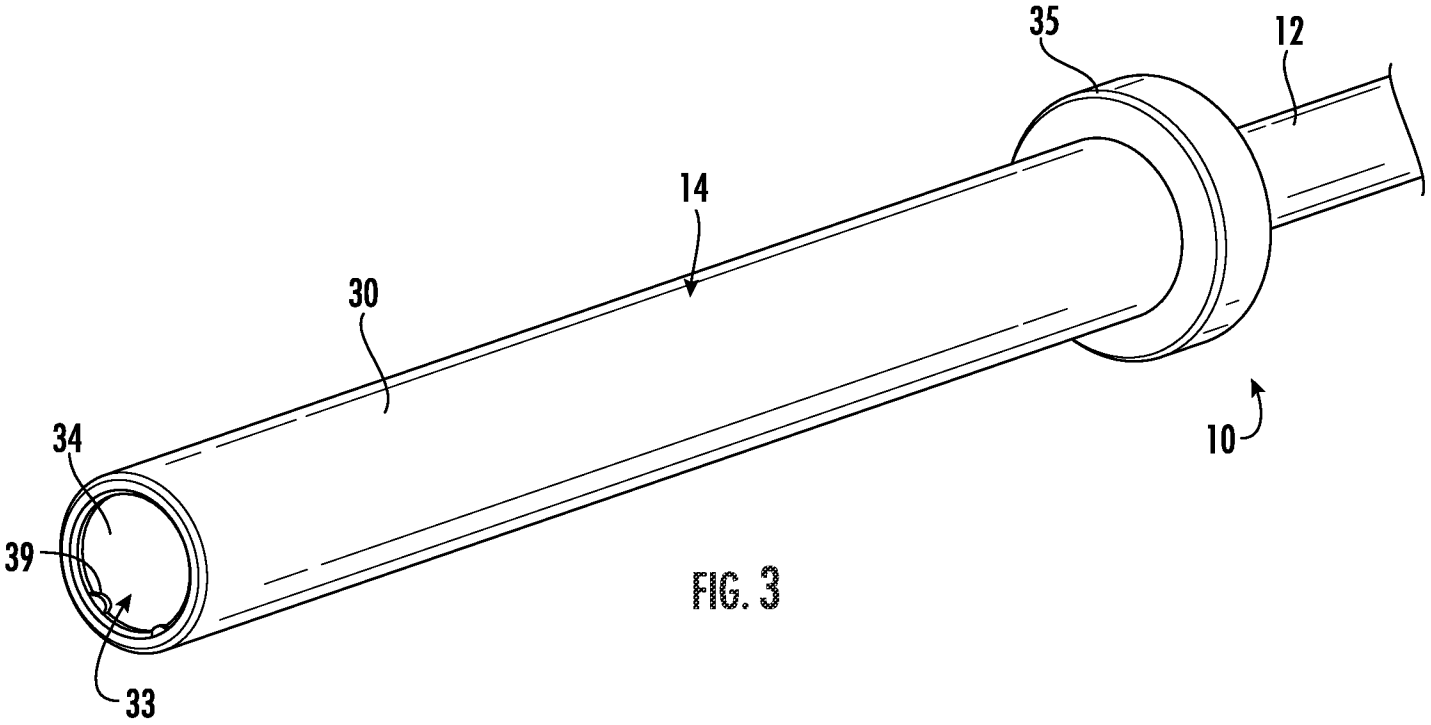
FIG. 3 is a perspective view of the first sleeve assembly of the barbell of FIG. 1.
Figure 4:
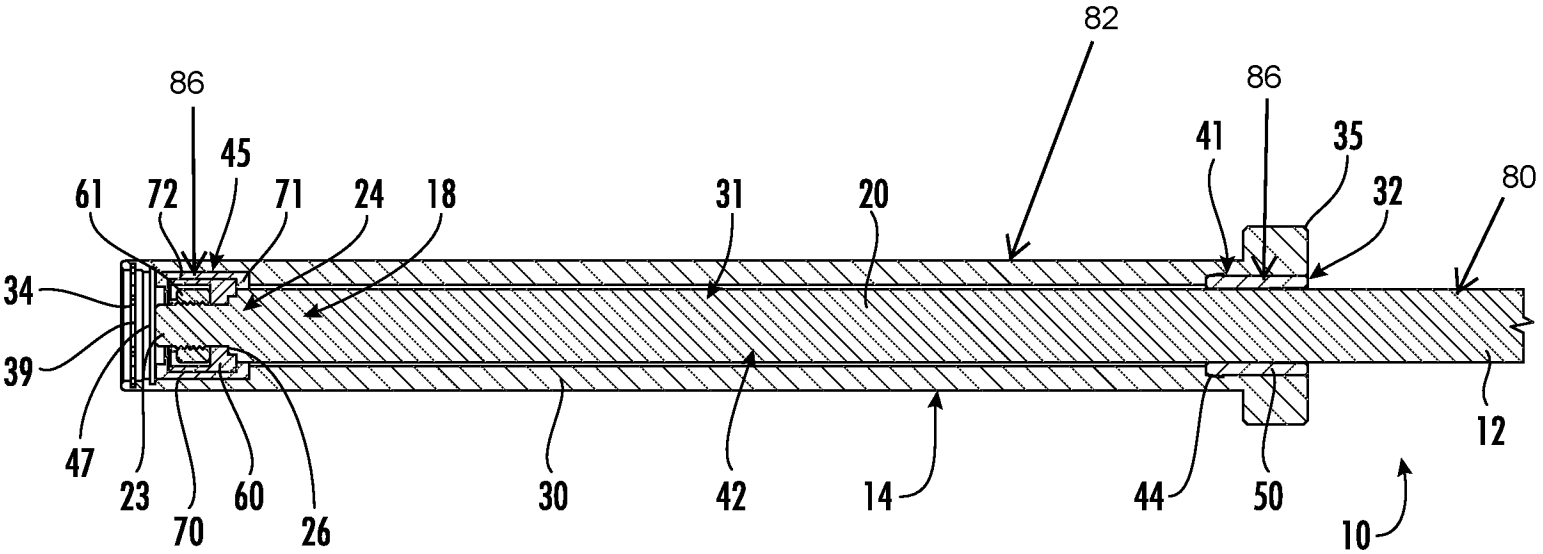
FIG. 4 is a cross-section view of the first sleeve assembly of the barbell of FIG. 1.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Figure 18:
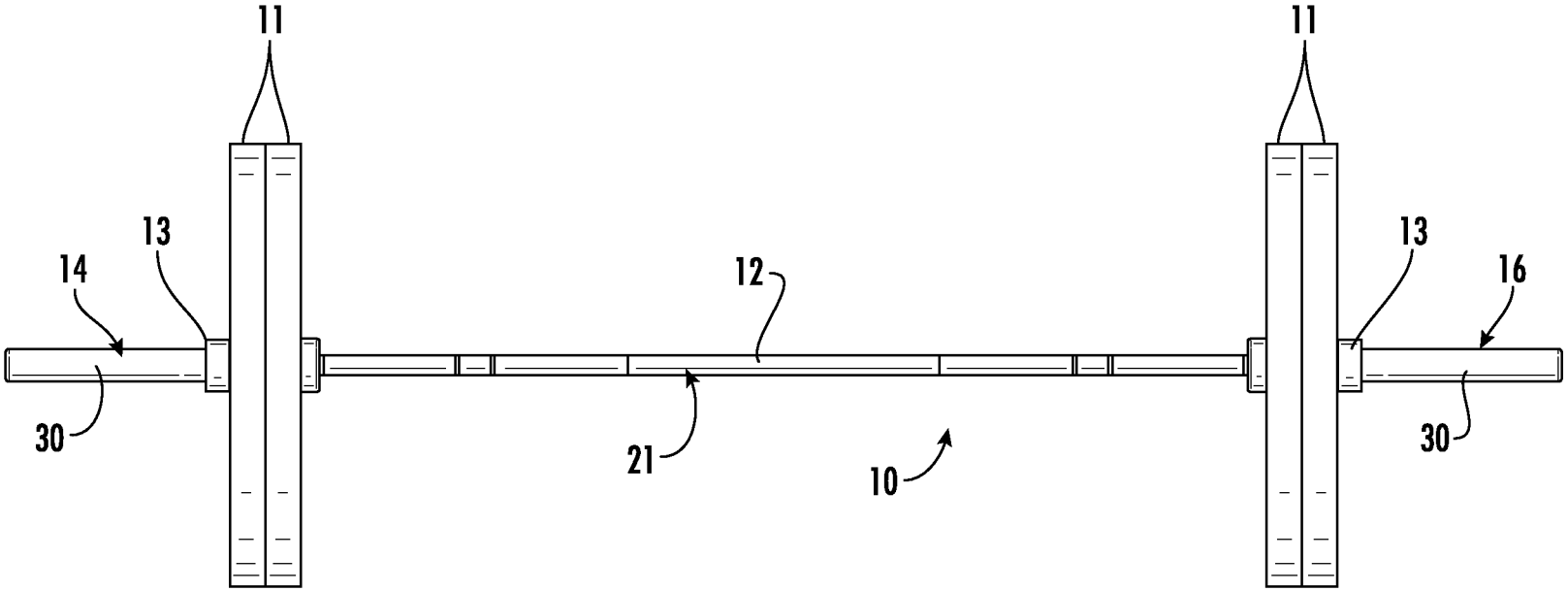
FIG. 18 is a plan view of the barbell of FIG. 1 with weights mounted on the barbell.

General aspects of the present disclosure relate to a barbell that includes structures for reducing noise and vibration when the barbell is dropped from an elevated position. FIGS. 1-18 illustrate one example embodiment of a barbell 10 according to aspects of the disclosure that includes a bar or bar member 12 having two opposed end portions 20, 22 with first and second sleeve assemblies 14, 16 positioned at the opposed end portions 20, 22 of the bar 12. The sleeve assemblies 14, 16 each include a sleeve or sleeve member 30 configured to hold one or more weights 11 (see FIG. 18), such as weight plates having a center hole configured to receive a portion of the sleeve 30 therethrough. Removable barbell collars 13 or other retaining devices may also be mounted on the sleeve assemblies 14, 16 to hold the weight(s) 11 in place. The barbell 12 also includes a connection assembly 18 that connects the bar 12 to the sleeve assemblies 14, 16 without any direct contact between the bar 12 and the sleeve 30 and without any metal parts directly contacting both the sleeve 30 and the bar 12. As used in this application: the term "axial" refers to the direction along the elongated length of the bar 12; the term "radial" refers to any direction perpendicular to the axial direction, e.g., along any radius of a cross-section of the bar 12 taken perpendicular to the axial direction; and the terms "proximal" and "distal" are relative terms referring to structures located toward the center of the bar 12 (proximal) or toward the ends of the bar 12 (distal), respectively, in the axial direction. These terms are intended for illustrative purposes only and do not limit the embodiments in any way.

The bar 12 has end portions 20, 22 that are connected to the sleeve assemblies 14, 16 and are received within the sleeves 30 of the sleeve assemblies 14, 16, as described in greater detail herein and a center portion 21 extending between the sleeve assemblies 14, 16. The bar 12 is configured for connection to fasteners 61 or other retaining members to the end portions 20, 22, and the bar 12 in FIGS. 1-10 has cylindrical posts or projections 23 extending axially outward from the end portions 20, 22 at the distal ends 24 of the bar 12. Each of the projections 23 in this embodiment has a threaded portion 25 configured for connection to a threaded fastener 61, as shown in FIGS. 4 and 7-10, but the projections 23 may have different connecting structure for connection to a different type of fastener or other retaining member (e.g., a retaining ring, a snap ring, a pin, a clip, etc.) in another embodiment. In a further embodiment, the fastener 61 may be a male fastener, such as a bolt, that extends into a female receiver on the bar 12 for connection, and the bar 12 may not include projections 23 in this configuration. The bar 12 in FIGS. 1-10 further has cylindrical shoulders 26 extending axially outward from the end portions 20, 22, such that the projections 23 each extend outward from the shoulders 26. The shoulders 26 have a peripheral dimension (e.g., diameter) and cross-sectional area that is larger than that of the end portions 20, 22 of the bar 12 but smaller than that of the projections 23. The shoulders 26 and the projections 23 in FIGS. 1-10 are illustrated as being cylindrical with a circular outer periphery, but either or both of these structures may have a different peripheral shape in another embodiment. The bar 12 is generally formed of metal, and in the embodiment of FIGS. 1-10, the bar 12 is formed of a single piece of steel.

The center portion 21 and the end portions 20, 22 of the bar 12 in this embodiment have a circular cross-section shape and a substantially constant diameter and cross-sectional area over the entire combined axial length of the center portion 21 and the end portions 20, 22. It is understood that the projections 23 in FIGS. 1-10 have a smaller diameter and cross-sectional area, and in one embodiment, the projections 23 may have a non-circular peripheral shape. The center portion 21 may further include structures to enhance gripping of the bar 12, such as knurling (not shown), and the bar 12 may be configured with or without knurling at the centermost portion of the bar 12. The end portions 20, 22 of the bar 12 in one embodiment have smooth outer surfaces to reduce friction on the outer surface. While the bar 12 is illustrated as a straight cylindrical member, it is understood that portions of the bar 12 may not be straight and/or cylindrical. For example, the bar 12 may include curves or bends or more complicated gripping structure, such as for use as a curl bar, a tricep bar, a deadlift bar, etc.

FIGS. 2-8 illustrate the connection of the sleeve assemblies 14, 16 to the bar 12 using the connection assembly 18. It is noted that FIGS. 2-8 illustrate only one of the sleeve assemblies 14 and the associated portions of the bar 12 and connection assembly 18, with the understanding that the other sleeve assembly 16 is constructed in a similar or identical manner in this embodiment. Each of the sleeve assemblies 14, 16 includes a sleeve 30 having an axial bore 31 with proximal and distal openings 32, 33 and a removable end cap 34 configured to cover the distal opening 33 of the sleeve 30. The bore 31 of each sleeve 30 is configured to receive one of the end portions 20, 22 of the bar 12 therein, such that the end portions 20, 22 enter the bore 31 of the respective sleeve 30 through the proximal opening 32. Each sleeve assembly 14, 16 also includes a collar 35 positioned at the proximal end of the sleeve 30. The collar 35 has a larger width/diameter than the outer surface of the sleeve 30, so the collar 35 can act as a stop to prevent any weights mounted on the sleeve 30 from sliding off of the sleeve 30 and onto the bar 12. In the embodiment of FIGS. 1-18, the collar 35 is integrally connected to the sleeve 30 and provided as a single piece with the sleeve 30. However, in another embodiment, the collar 35 may be separately connected to the sleeve 30 and/or the bar 12. The sleeve 30 and the collar 35 are generally formed of metal, and in FIGS. 1-18, these parts are formed as a single piece of steel. The inner surface 36 of each sleeve 30 has a circumferentially positioned annular abutment surface 37 with a smaller width/diameter than the distal opening 33, such that the end cap 34 is inserted into the bore 31 through the distal opening 33 and abuts the abutment surface 37. An annular groove 38 is positioned adjacent the abutment surface that receives a C-shaped snap ring 39 to secure the end cap 34 to close the distal opening 33. Each end cap 34 is a plate member formed of stamped steel with a cushion member 40 on the inner side, which may be a single-sided rubber tape in one embodiment.

In the embodiment of FIGS. 1-18, the minimum inner diameter ID1 of the bore 31 is defined by a central portion 42 of the bore 31 that extends over a majority of the axial length of the sleeve 30. The minimum inner diameter ID1 of the passage 30 is greater than the maximum outer diameter OD of the end portions 20, 22 of the bar 12, such that the end portions 20, 22 of the bar 12 are received in the passages 31 of the sleeve 30 without contacting the inner surface 36 at any point. The connection assembly 18 includes bushings and/or other spacing structures spacing the end portions 20, 22 of the bar from the inner surface 36 of the sleeve 30, and the inner surface 36 of the sleeve 30 includes structures for engaging components of the connection assembly 18. Each connection assembly 18 includes at least a proximal bushing 50 engaging the sleeve 30 and the bar 12 at or proximate to the proximal opening 32 of the bore 31, a barrel 60 fixedly connected to the distal end 24 of the bar 12 using a fastener 61 or other retaining structure, and a distal bushing 70 engaging the sleeve 30 and the barrel 60 at or proximate the distal end 24 of the bar 12. All of these components of the connection assembly 18 are partially or entirely received in the bore 31 of the sleeve 30. In another embodiment, either or both of the proximal bushing 50 and the distal bushing 70 may be replaced by a bearing or a bushing/bearing combination. If a bearing is used, the bearing may be partially encapsulated or lined with a polymer material as discussed herein.

The proximal bushing 50 in the embodiment of FIGS. 1-18 is shown in greater detail in FIGS. 5-6 and 16-17. In this embodiment, the proximal bushing 50 has a bushing body 51 that is generally tubular with circular cylindrical outer and inner surfaces 52, 53, with the inner surface 53 defining an axial passage 54 extending through the bushing body 51 from a proximal end 55 to a distal end 56. The proximal bushing 50 is positioned such that the outer surface 52 engages the inner surface 36 of the sleeve 30, and one of the end portions 20, 22 of the bar 12 passes through the passage 54 and engages the inner surface 53 of the proximal bushing 50. The engagement between the proximal bushing 50 and the bar 12 is not fixed in the embodiment of FIGS. 1-18, and the inner surface 53 of the proximal bushing 50 is a smooth, low-friction surface such that the sleeve 30 and the proximal bushing 50 can rotate together freely and smoothly with respect to the bar 12.

Figure 5:
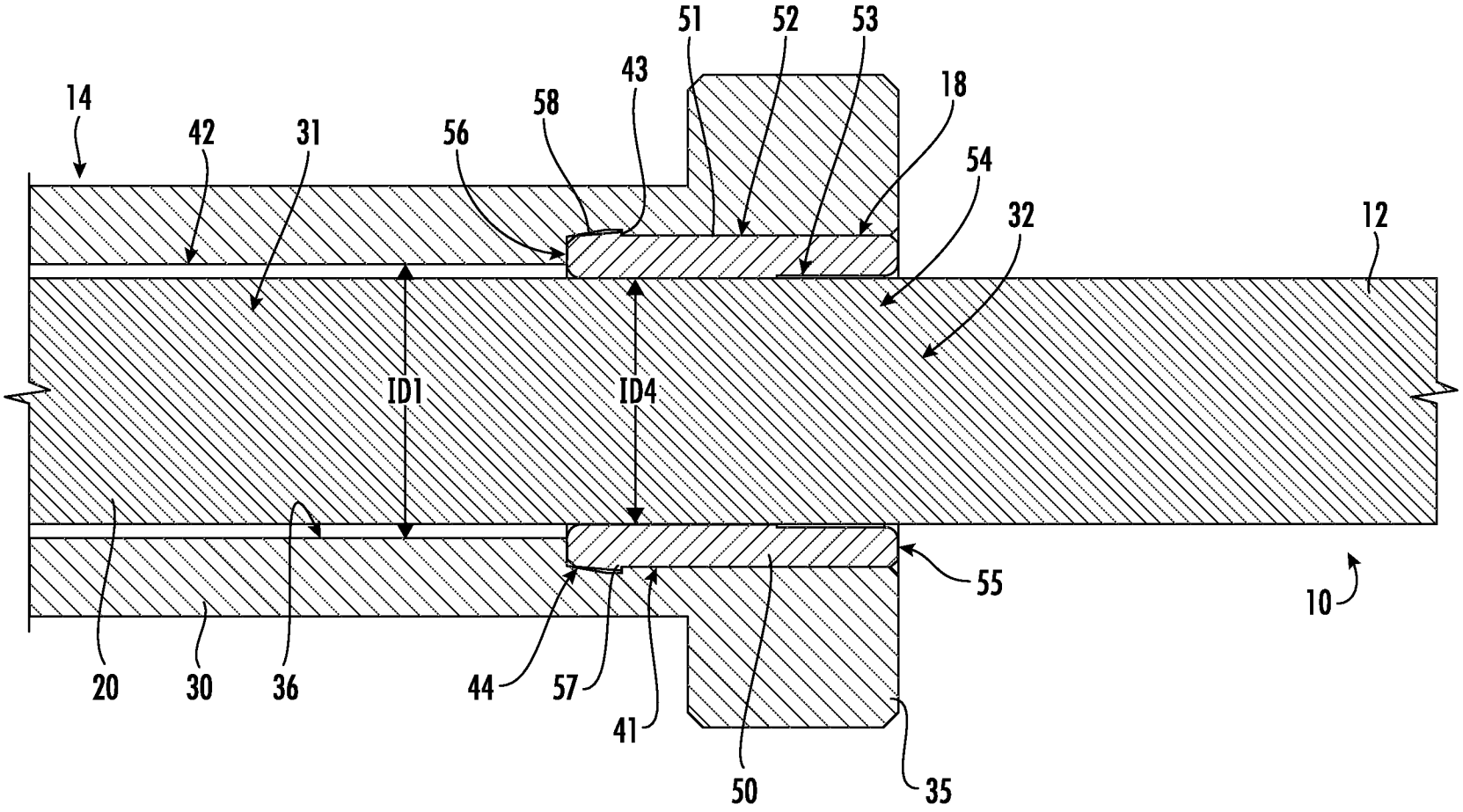
FIG. 5 is a magnified cross-section view of a portion of the first sleeve assembly of the barbell of FIG. 1.
Figure 6:
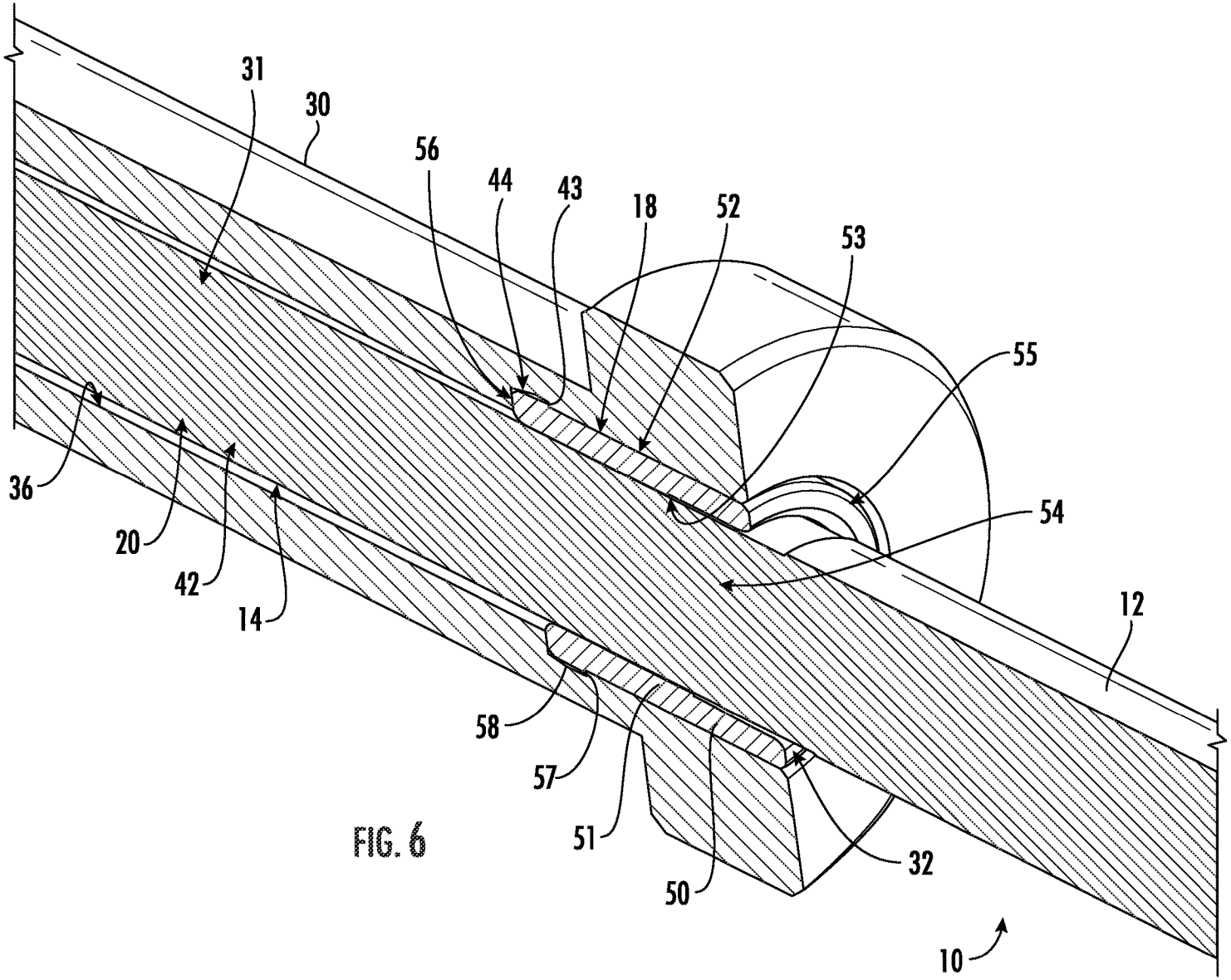
FIG. 6 is a perspective cross-section view of the portion of the first sleeve assembly shown in FIG. 5.

The proximal bushing 50 has an engaging surface 57 extending outward from the outer surface 52 proximate the distal end 56, which is provided in the form of an annular shoulder in the embodiment of FIGS. 1-18. The proximal bushing 50 in the embodiment of FIGS. 1-18 also has a ramped surface 58 located between the engaging surface 57 and the distal end 56. The ramped surface 58 is arranged as an annular structure that is angled with respect to the axial direction AD and with respect to the outer surface 52 of the proximal bushing 50. The sleeve 30 has a first bore portion or proximal bore portion 41 extending inwardly/distally from the proximal opening 32 of the sleeve 30, having a larger inner width/diameter ID2 than the inner diameter ID1 of the central portion 42 (see FIG. 11). The first bore portion 41 may be considered to be an annular recess with respect to the central portion 42 of the bore 31. The proximal bushing 50 is received in the first bore portion 41, which is dimensioned similarly to the outer surface 52 of the proximal bushing 50 to achieve tight engagement. The first bore portion 41 further has an engagement surface 43 that is defined by an annular groove 44 that is spaced inwardly/distally from the proximal opening 32. When the proximal bushing 50 is received in the first bore portion 41, the engaging surface 57 and the ramped surface 58 of the bushing 50 are received in the groove 44, and the engaging surface 57 abuttingly engages the engagement surface 43 of the sleeve 30 to retain the bushing 50 within the recess 41. The proximal bushing 50 may be inserted by pushing the distal end 56 of the bushing 50 into the proximal opening 32 of the sleeve 30, and the ramped surface 58 assists in this insertion, such as by causing the bushing body 51 to flex slightly inwardly. The proximal opening 32 of the sleeve 30 may be beveled or chamfered in order to further assist this insertion, such as shown in FIGS. 5-6. Once inserted, the proximal end 55 of the proximal bushing 50 is exposed within the proximal opening 32 of the sleeve 30. In other embodiments, the engaging surface 57 and/or the ramped surface 58 may have a different structure, such as an intermittent structure including a plurality of tabs, ridges, or shoulders extending outwardly from the outer surface 52, and the engaging surface 57 may be positioned closer to or further from the distal end 56 and/or may not include the ramped surface 58. It is understood that the engaging surface 57 of the proximal bushing 50 and the engagement surface 43 of the sleeve 30 may be transposed in a further embodiment, so that the sleeve 30 has a radially projecting tab or ridge that is received in a notch in the bushing 50.

Additionally, in the embodiment of FIGS. 1-18, the axial passage 54 of the proximal bushing 30 has an inner diameter ID4 defined by the inner surface 53, and the inner diameter ID4 is smaller than the inner diameter ID1 of the central portion 42, as shown in FIG. 5. In this configuration, one of the end portions 20, 22 of the bar 12 engages the inner surface 53 of the proximal bushing 50 within the axial passage 54 but is spaced from the inner surface 36 of the sleeve 30 at the central portion 42. The sleeve 30 in FIGS. 1-18 is configured such that the distal end 56 of the first bore portion 41 is defined at the distal end of the groove 44, and the bore 31 has a step change in diameter from the larger diameter of the groove 44 to the minimum inner diameter ID1 defined at the central portion 42 of the bore 31.

The barrel 60 is fixedly connected to the distal end 24 of the bar 12 using a fastener 61 in the embodiment of FIGS. 1-18, and the barrel 60 and fastener 61 in this embodiment are illustrated in greater detail in FIGS. 7-8 and 14-15. In general, the barrel 60 is configured to engage the distal end of the bar 24 and the distal bushing 70 to permit relative rotation between the bar 12 and the distal bushing 70. In the embodiment of FIGS. 1-18, the barrel 60 fixedly engages the distal end 24 of the bar 12 and engages the distal bushing 70 in a manner that permits the barrel 60 and the bar 12 to rotate with respect to the distal bushing 70, although this configuration may be different in other embodiments. For example, the connection between the bar 12 and the barrel 60 may permit the barrel 60 to rotate with respect to the bar 12, such as by including a bearing or other structure to facilitate rotation. The fastener 61 is illustrated as a locking nut, but other fasteners may be used in other embodiments, and it is understood that the bar 12 and the fastener 61 may have complementary structures for connection. The barrel 60 in this embodiment has a cylindrical outer surface 62 and an axial passage 63 formed by a distal cavity 64 extending inward from the distal end 67, a proximal cavity 65 extending inward from the proximal end 68, and an aperture 66 extending between and connecting the proximal and distal cavities 64, 65. The aperture 66 is smaller in width/diameter than the distal cavity 64 and the proximal cavity 65. Additionally, the distal cavity 64 has a larger width/diameter than the proximal cavity 65 to provide room for manipulation of the fastener 61, but this structure may not be used in other embodiments. The barrel 60 is fixedly connected to the end portions 20, 22 of the bar 12 by one of the projections 23 extending axially through the aperture 66 and into the distal cavity 64, with the fastener 61 being positioned in the distal cavity 64 and connected to the projection 23. In this configuration, the shoulder 26 of the bar 12 is received in the proximal cavity 65, and the surfaces 27 of the distal end 24 of the bar 12 surrounding the shoulder 26 abut the end of the barrel 60. Both the proximal and distal cavities 64, 65 are cylindrical in the embodiment of FIGS. 1-18, and it is understood that the shape of the proximal cavity 64 may be configured to match the shape of the shoulder 26 of the bar 12 in order to resist relative movement of the barrel 60 and the bar 12. The outer width/diameter of the barrel 60 is greater than the width/diameter of the end portion 20, 22 of the bar 12, such that portions of the proximal end 68 of the barrel 60 extend radially outward of the bar 12. In another embodiment, the bar 12 may not include the shoulder 26, and the proximal cavity 64 may receive the distal end 24 of the bar 12, or no proximal cavity 64 may be provided.

The distal bushing 70 engages the barrel 60 and the sleeve 30 from both axial directions in order to limit axial movement of the barrel 60 with respect to the sleeve 30, and thereby limit axial movement of the sleeve 30 with respect to the bar 12. The sleeve 30, the distal bushing 70, the barrel 60, and the bar 12 in the embodiment of FIGS. 1-18 may be fixed against axial movement by these structures. In the embodiment of FIGS. 1-18, the distal bushing 70 is formed of two separate bushing pieces or portions (also referred to as first and second bushing portions or proximal and distal bushing portions) 71, 72 that are similar or identical to each other and abuttingly engage each other in the axial direction. In another embodiment, the distal bushing 70 may be a single piece or multiple pieces that are not identical to each other. The identical first and second bushing portions 71, 72 are shown in greater detail in FIGS. 7-8 and 12-13. Each bushing portion 71, 72 in the embodiment of FIGS. 1-18 is a cup-shaped piece that includes a cylindrical wall 77 having a cylindrical outer surface 73 and a cylindrical inner surface 78 defining a cylindrical inner cavity 74 and a flange 75 positioned around an aperture 76 extending to the inner cavity 74. The two bushing portions 71, 72 are positioned so the ends of the cylindrical walls 77 face and abut each other and the inner cavities 74 are contiguous with each other to define a single cavity that receives the barrel 60, with the bushing portions 71, 72 thereby combining to form the distal bushing 70 that surrounds the barrel 60. In this configuration, the inner surface 78 of the cylindrical wall 77 confronts and engages the outer surface 62 of the barrel 60, and the flanges 75 of the bushing portions 71, 72 abuttingly engage the distal and proximal ends 67, 68 of the barrel 60, such that axial and radial movement of the barrel 60 relative to the distal bushing 70 is limited. The barrel 60 and the distal bushing 70 may be fixed against relative axial and radial movement by this structure.

The end portion 20, 22 of the bar 12 extends through the aperture 76 of the first bushing portion 71 to connect to the barrel 60. The distal bushing 70 and the barrel 60 are not fixed against rotation relative to each other, and the barrel 60 can rotate together with the bar 12 within the cavities 74 of the distal bushing 70. It is noted that the flanges 75 of the bushing portions 71, 72 are formed as annular structures in the embodiment of FIGS. 1-18, and in other embodiments, one or both of the flanges 75 may be formed as a different structure that functions to abuttingly engage the distal and proximal ends 67, 68 of the barrel 60, including a plurality of intermittently spaced inwardly extending walls. It is understood that the first and second bushing portions 71, 72 may not be identical to each other in another embodiment, and that the bushing portions 71, 72 may be configured to match the shapes of the barrel 60 and/or adjacent portions of the sleeve 30.

Figure 7:
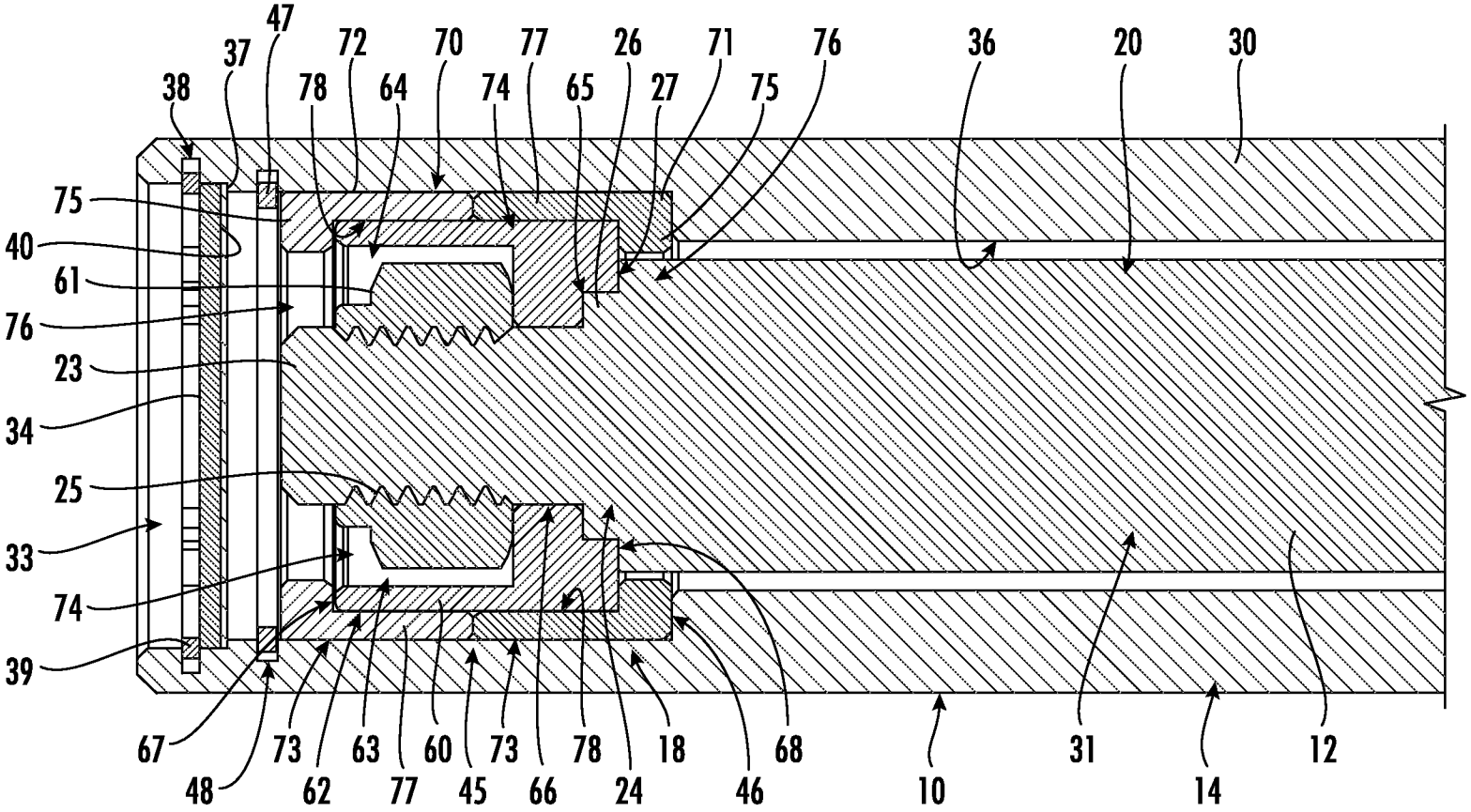
FIG. 7 is a cross-section view of another portion of the first sleeve assembly of the barbell of FIG. 1.
Figure 8:
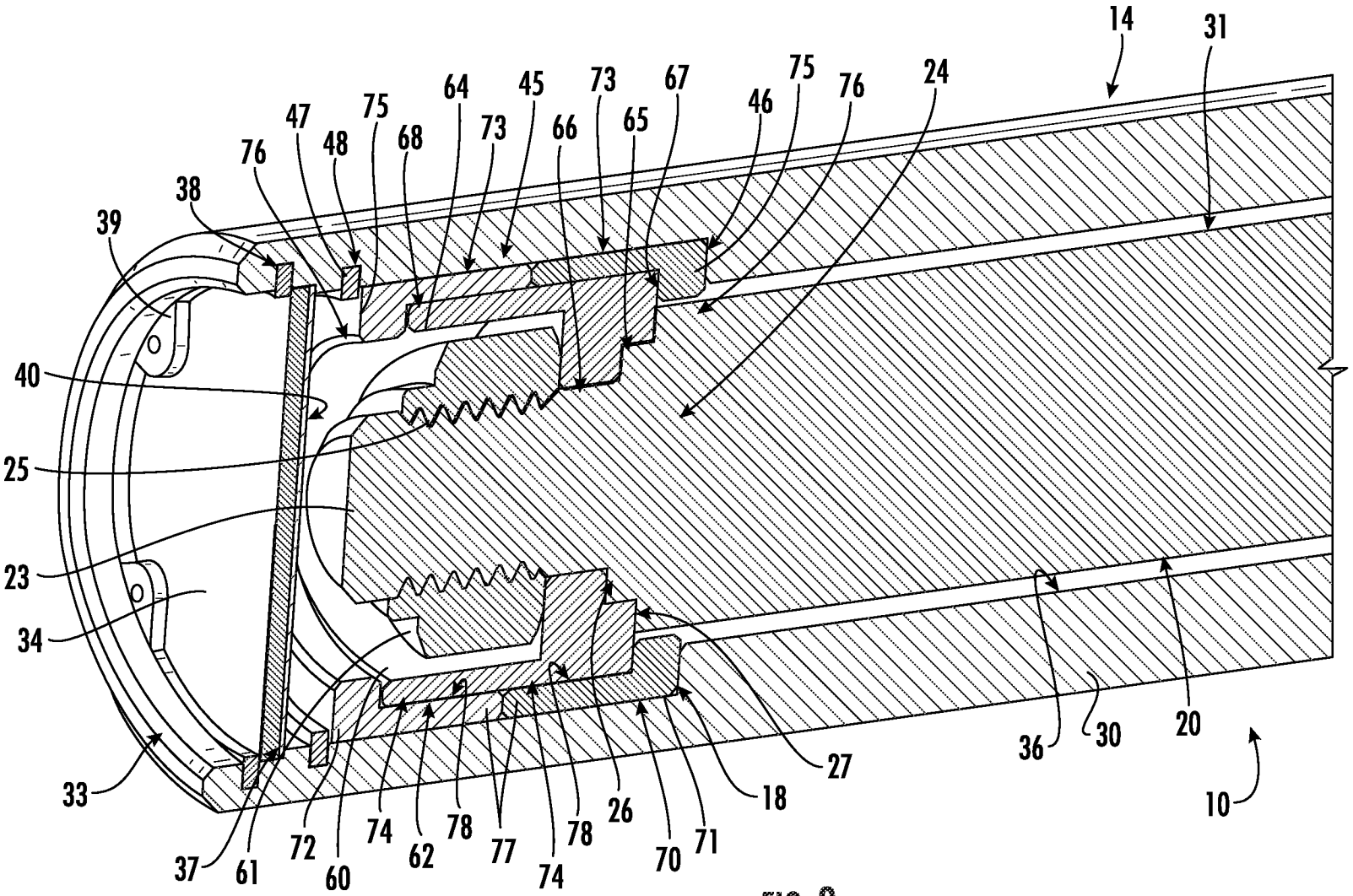
FIG. 8 is a perspective cross-section view of the portion of the first sleeve assembly shown in FIG. 7.
Figure 9:
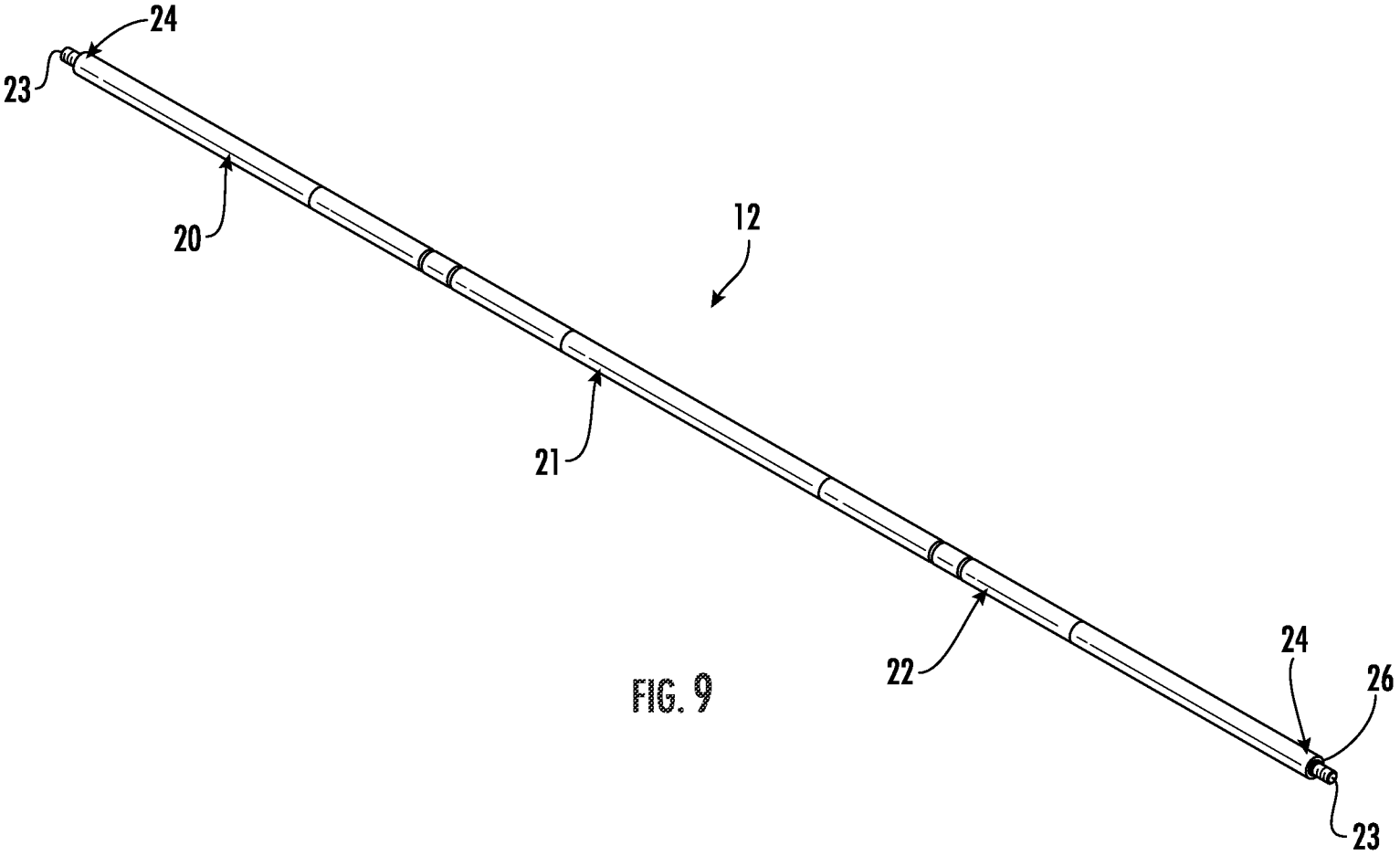
FIG. 9 is a perspective view of a bar of the barbell of FIG. 1.
Figure 10:
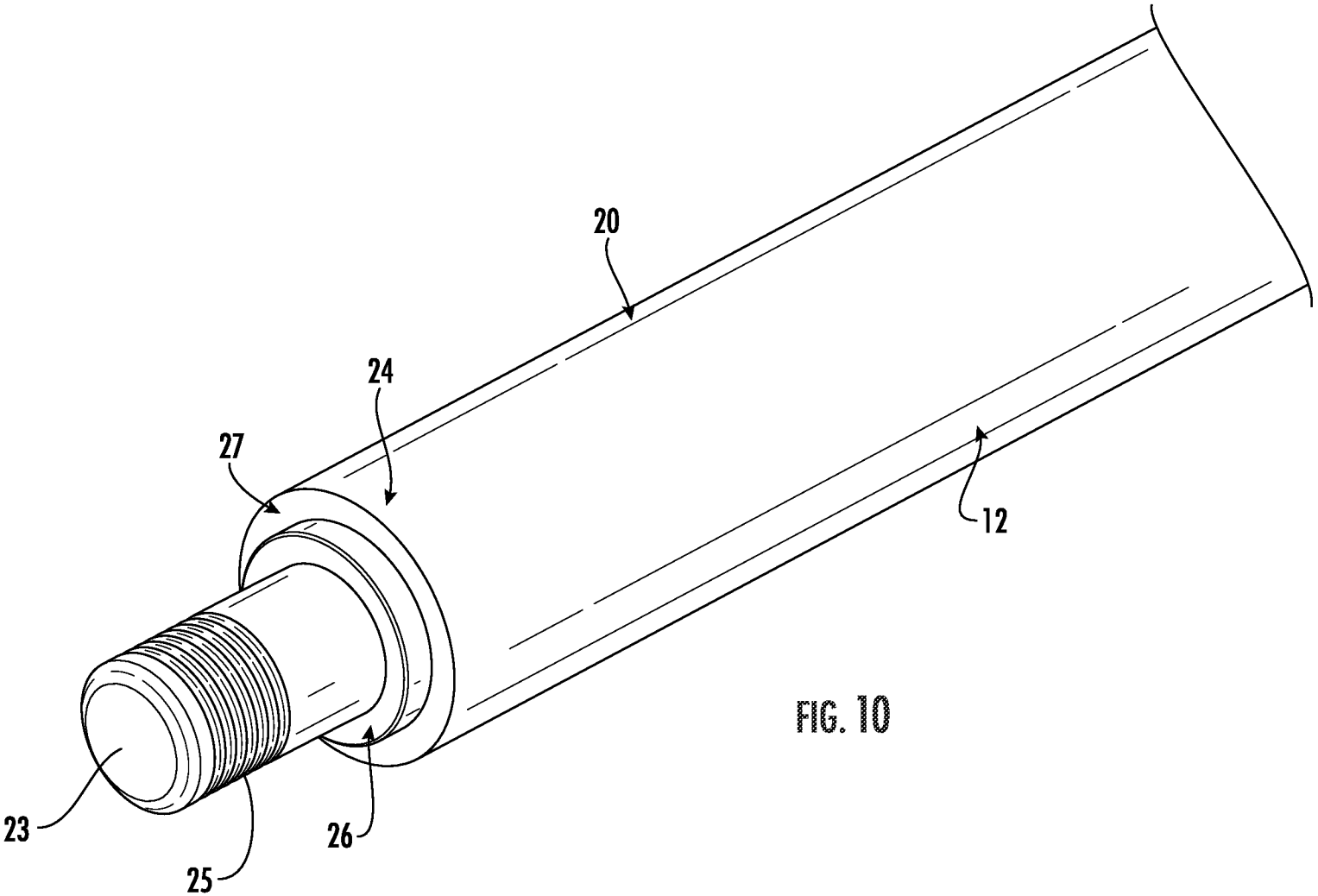
FIG. 10 is a perspective view of a first end portion of the barbell of FIG. 1.

Additionally, in the embodiment of FIGS. 1-18, the diameter of the aperture 76 defined by the flange 75 of the first bushing portion 71 is smaller than the inner diameter ID1 of the central portion 42 of the bore 31, as shown in FIG. 7. In this configuration, the flange 75 of the first bushing portion 71 may engage the bar 12 or may be spaced from the bar 12. If the flange 75 is spaced from the bar 12 around the aperture 76, such space is smaller than the space between the bar 12 and the inner surface 36 of the sleeve 30 at the central portion 42 of the bore 31.

In other embodiments, the barbell 10 may not include a barrel 60 that is separate from the bar 12 on one or both end portions 20, 22. For example, the bar 12 may include integrally formed barrels 60 or similar structures, or a combination of one integrally formed barrel 60 and one separate barrel 60 at the two end portions 20, 22. As another example, the distal bushing 70 may be configured to engage the bar 12 directly, and another structure (e.g., a retaining ring, split washer, end cap, etc.) may be used for axially fixing the bar 12 with respect to the sleeve 30. Still further embodiments may be used, such as the embodiment of FIG. 19 disclosed herein.

Figure 11:
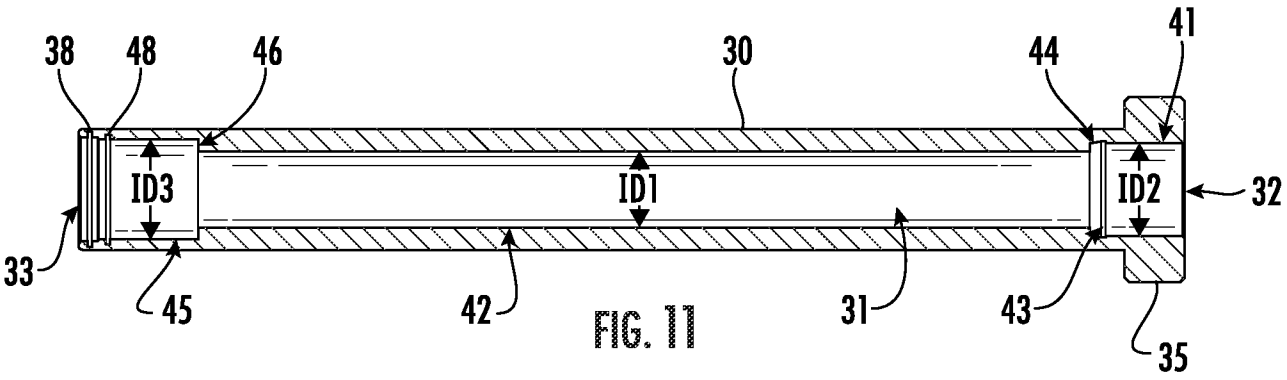
FIG. 11 is a cross-section view of a sleeve of the barbell of FIG. 1.
Figure 12:
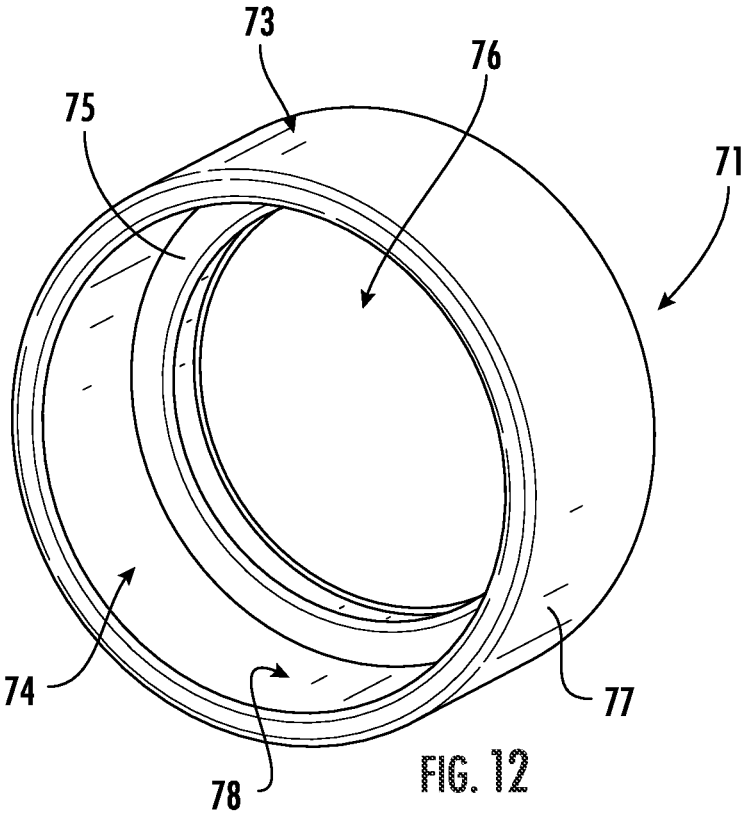
FIG. 12 is a perspective view of a first bushing portion of a distal bushing of the barbell of FIG. 1.
Figure 13:
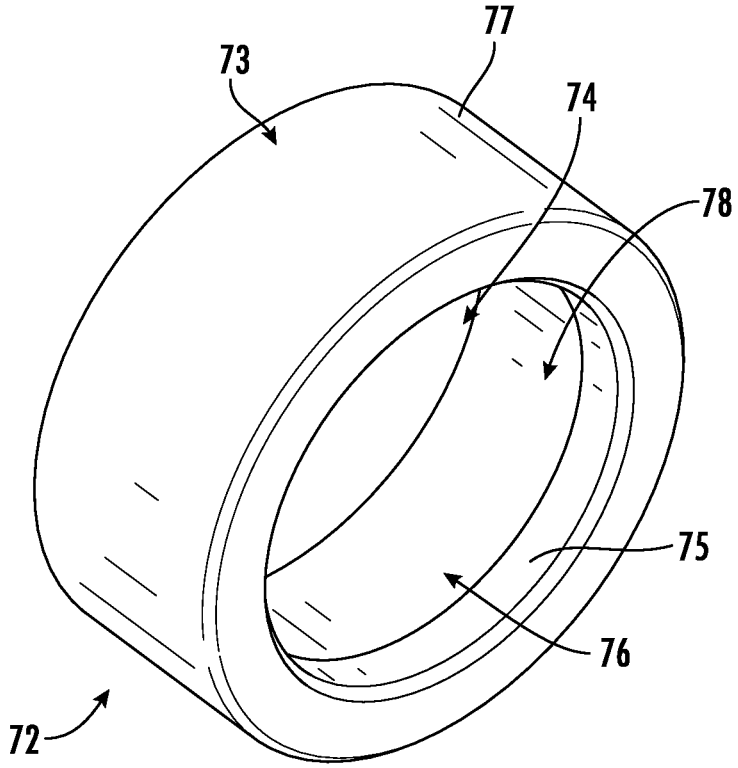
FIG. 13 is a perspective view of a second bushing portion of the distal bushing of the barbell of FIG. 1 that is identical to the first bushing portion of FIG. 12.
Figure 14:
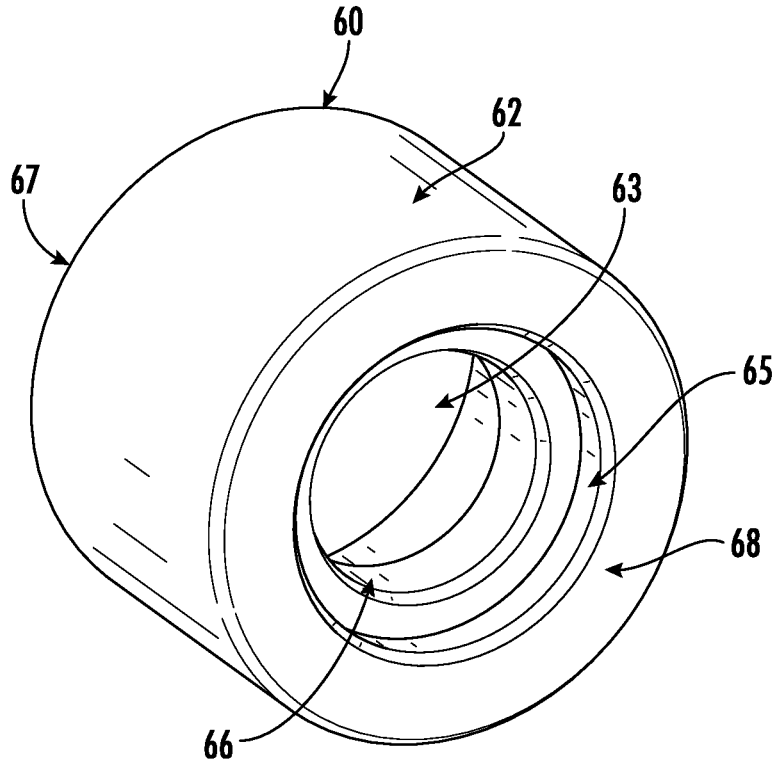
FIG. 14 is a perspective view of a barrel of the barbell of FIG. 1.
Figure 15:
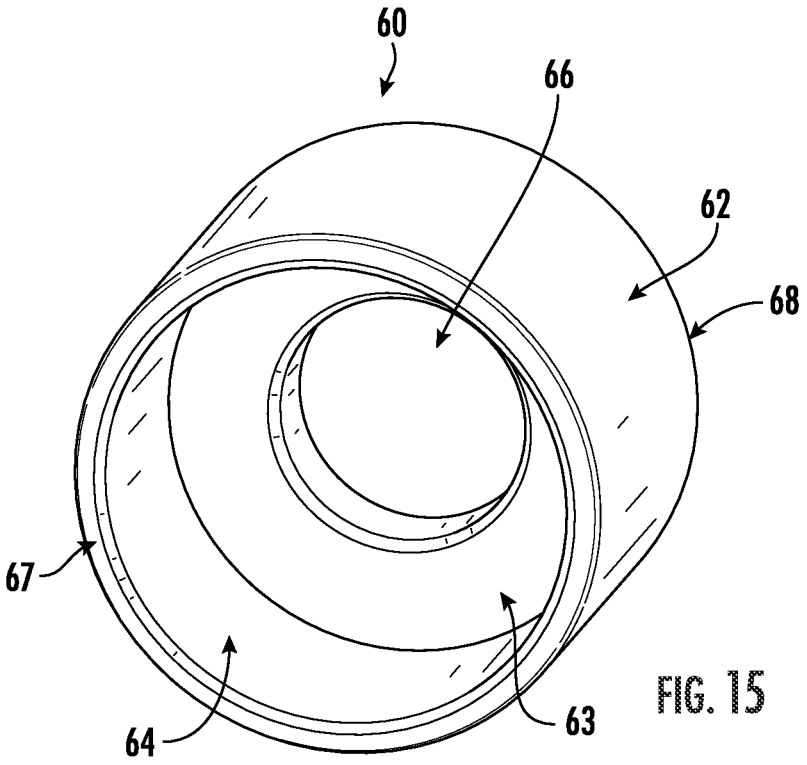
FIG. 15 is another perspective view of the barrel of FIG. 14.
Figure 16:
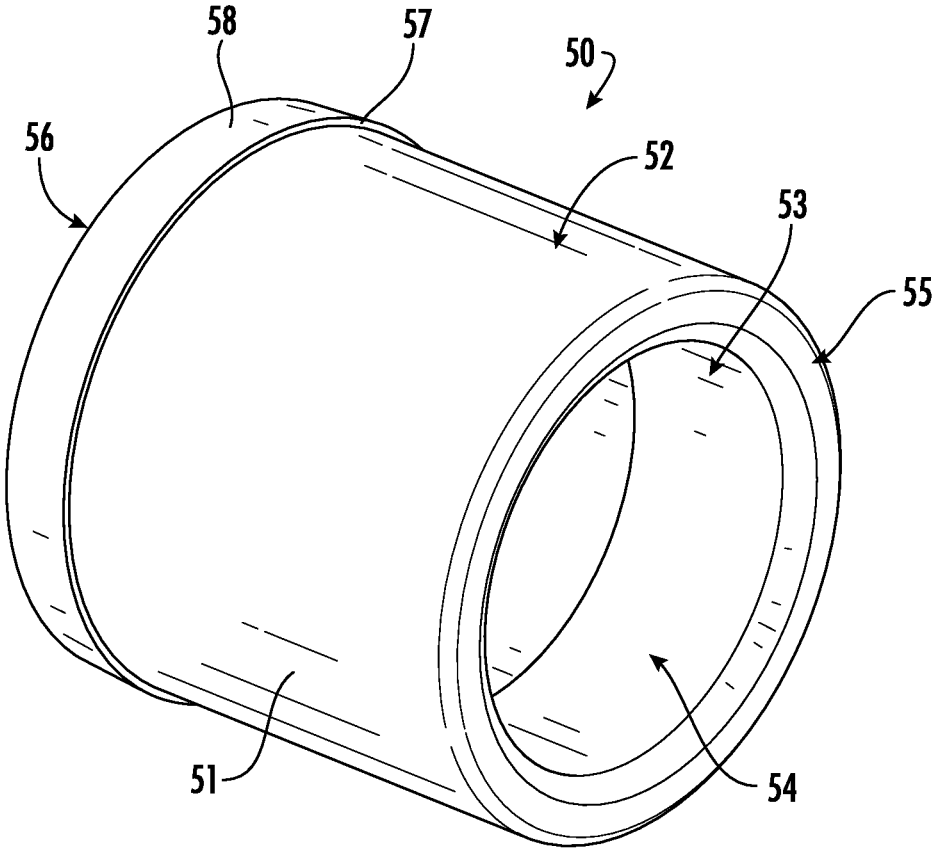
FIG. 16 is a perspective view of a proximal bushing of the barbell of FIG. 1.
Figure 17:
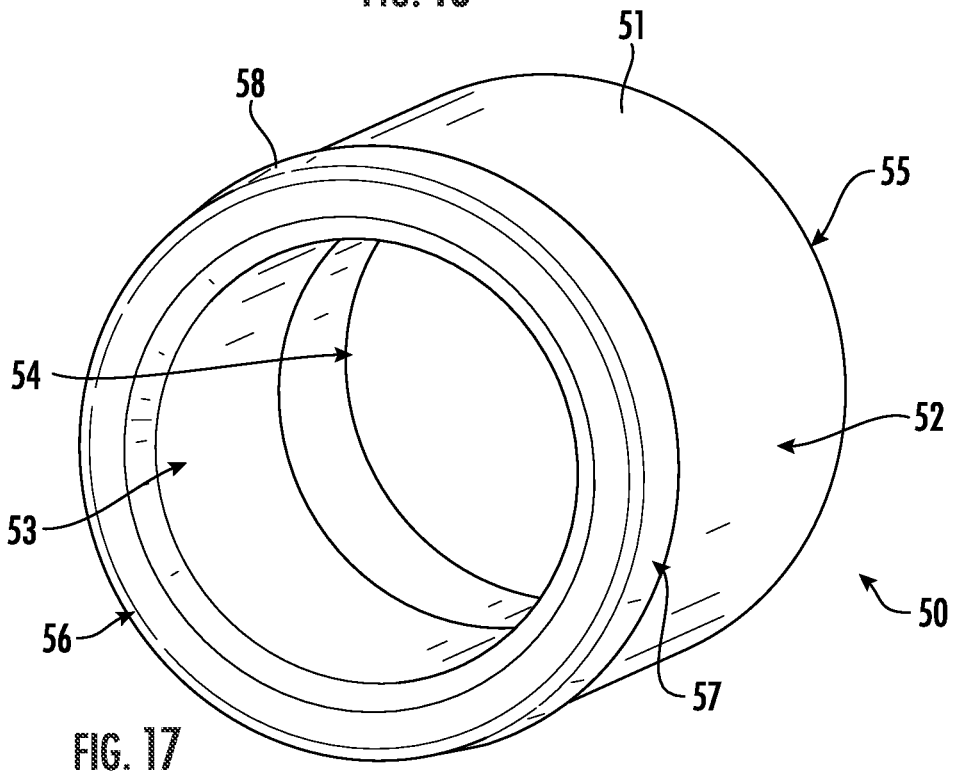
FIG. 17 is another perspective view of the proximal bushing of FIG. 16.

The sleeve 30 has a second bore portion or distal bore portion 45 extending inwardly/proximally from the distal opening 33 of the sleeve 30, having a larger inner width/diameter ID3 than the inner diameter ID1 of the central bore portion 42 (see FIG. 11). The second bore portion 45 may be considered to be an annular recess with respect to the central portion 42 of the bore 31. The distal bushing 70 and the barrel 60 are received in the second bore portion 45, which is dimensioned similarly to the outer surface 73 of the distal bushing 70 to limit radial movement of the distal bushing 70 with respect to the sleeve 30 and/or to fix the distal bushing 70 against radial movement with respect to the sleeve 30. An abutment surface 46 is positioned at the proximal end of the second bore portion 45, and in this embodiment, the abutment surface 46 is formed as a shoulder that creates a change in diameter between the second bore portion 45 and the central bore portion 42. The abutment surface 46 abuts the first bushing portion 71 at the proximal end of distal bushing 70, e.g., at the end of the cylindrical wall 77 and/or the outer surface of the flange 75. The sleeve assembly 14, 16 also includes a retaining member to abut the second bushing portion 72 at the distal end of the distal bushing 70, and the retaining member in the embodiment of FIGS. 1-18 is a C-shaped snap ring 47 that is received in an annular groove 48. The abutment surface 46 and the snap ring 47 abuttingly engage the proximal and distal ends of the distal bushing 70 to limit axial movement of the distal bushing 70 with respect to the sleeve 30. In the embodiment of FIGS. 1-18, these structures fix the distal bushing 70 against axial movement with respect to the sleeve 30, which thereby fixes the barrel 60 and the bar 12 against axial movement with respect to the sleeve 30. In this configuration, the entire axial load between the bar 12 and the sleeves 30 is exerted on the barrel 60 and the distal bushing 70. The distal bushing 70 in FIGS. 1-18 permits the sleeve 30 to be rotatable relative to the barrel 60 and the bar 12, which are fixed against rotation with respect to each other. The inner and outer surfaces 78, 73 of the distal bushing 70 are smooth, low-friction surfaces such that the sleeve 30 can rotate freely and smoothly with respect to the bar 12 and the barrel 60, and both the sleeve 30 and the barrel 60 are rotatable with respect to the distal bushing 70. In another embodiment, the distal bushing 70 may be fixed against rotation with respect to either the barrel 60 or the sleeve 30, such that the distal bushing 70 rotates together with either the sleeve 30 or the barrel 60.

In an example embodiment, the proximal bushings 50 and the bushing portions 71, 72 of the distal bushings 70 are all made from polymer materials, which includes pure and mixed polymer materials, as well as polymer-matrix composite materials. These components may be manufactured using any of a variety of techniques or combinations of such techniques, including molding, casting, thermoforming, extrusion, machining, etc. The proximal bushings 50 and the bushing portions 71, 72 may all be made from the same polymer material, or some or all of these components may be made from different polymer materials, in various embodiments. The polymer material may be selected based on desirable properties, including strength, durability, low friction properties (e.g., coefficient of friction), and vibration/sound absorption or damping properties. In one embodiment, the polymer material may have a durometer hardness of 50 Shore A to 100 Shore A. One example of a suitable material that provides advantageous performance in this application is a urethane or polyurethane material. Other polymer materials may provide suitable and/or advantageous performance as well. Further, one or more surfaces of the barbell 10, including the inner and outer surfaces 78, 73 of the portions 71, 72 of the distal bushings 70, the inner surfaces 53 of the proximal bushings 50, the outer surface 62 of the barrel 60, and/or the outer surfaces of the end portions 20, 22 of the bar 12, may have a lubricant applied thereto in order to further reduce friction during rotation of the sleeves 30 with respect to the bar 12. The polymer material(s) of the bushings 50, 70 may be selected for lubricity properties and compatibility with potential lubricants, in such a configuration.

It is understood that the polymer bushings 50, 70 may have inserts, cores, or other internal components or portions made from other materials, such as metal, in one embodiment. For example, either or both of the bushings 50, 70 and/or components thereof may be made from metal pieces coated with a polymer material on one or more surfaces, e.g., a polymer piece with a metal core. Such bushings 50, 70 and/or components thereof are still considered to be formed of a polymer material as discussed herein. The advantages described herein are achieved in part by configuring the barbell so that, for each pair of surfaces of the barbell 10 that engage each other (particularly in moveable engagement) with clearances that are greater than or equal to a specific threshold, at least one of the pair of surfaces is a polymer surface, i.e., a surface formed of a polymer material. The specific threshold may be at least 0.001 inch in one embodiment, or 0.002 inch in another embodiment. In the embodiment of FIGS. 1-18, the pairs of surfaces that engage each other with clearances of at least 0.001" include at least the following: the outer surface 52 of the proximal bushing 50 and the inner surface 36 of the sleeve 30; the inner surface 53 of the proximal bushing 50 and the bar 12; the outer surface 78 of the distal bushing 70 and the inner surface 36 of the sleeve 30; the inner surface 73 of the distal bushing 70 and the outer surface 62 of the barrel 60; the abutment surface 46 and the proximal end of the distal bushing 70; the snap ring 47 and the distal end of the distal bushing 70; the distal flange 75 of the distal bushing 70 and the distal end 67 of the barrel 60; the proximal flange 75 of the distal bushing 70 and the proximal end 68 of the barrel 60; and the abutting surfaces of the first and second bushing portions 71, 72 of the distal bushing 70. In one embodiment, each of these pairs of surfaces includes at least one polymer surface. This can be accomplished, in one embodiment, by having all outer surfaces of the proximal and distal bushings 50, 70 formed of a polymer material.

In the embodiment of FIGS. 1-18, at least the outer and/or inner surfaces 52, 53, 78, 73 of the bushings 50, 70 are polymer surfaces (i.e., the surfaces that engage the bar 12, the barrel 60, and/or the sleeve 30). This configuration avoids metal-on-metal contact between the bar 12, the barrel 60, the sleeve 30, and other connecting and retaining structures, as disclosed herein. Thus, the bushings 50, 70 may have at least their outer and/or inner surfaces 52, 53, 78, 73, or any other surfaces that engage metallic components such as the bar 12, the barrel 60, the sleeve 30, and/or the snap rings 47, formed of a polymer material. Portions of a metallic insert or core may be exposed in one or more locations, which may be a location that does not engage other metallic components, e.g., the bar 12, the barrel 60, the sleeve 30, the snap rings 47, etc. In another embodiment, the bushings 50, 70 may have a polymer material on only one surface, such as the inner surface engaging the bar 12 or barrel 60, to avoid metal-on-metal contact between the bushings 50, 70 and the bar 12 or barrel 60. For example, one or more of the bushings 50, 70 may have a metal outer surface that is interference fit within the bore 31 (a fixed connection with a clearance of less than 0.001") and an inner polymer layer for contacting the bar 12, the barrel 60, or other portions that rotate within the bushings 50, 70. In a further embodiment, a portion of the bar 12 and/or the end portions 20, 22 thereof, may be coated in a polymer material instead of, or in addition to, the bushings 50, 70 being formed of polymer materials as described herein.

It is also understood that components described herein as being formed of a polymer material, e.g., the bushings 50, 70 and/or components thereof, may be formed of different polymer materials. Accordingly, components described herein as being "formed of a polymer material" may be considered to be formed of one or more polymer materials, such that a first component is formed of a first polymer material, a second component is formed of a second polymer material, etc., which materials may be the same or different.

In the configuration shown in FIGS. 1-18 and described above, the barbell 10 includes a first rotational body 80 that includes the bar 12, the barrels 60, and the fasteners 61, a second rotational body 82 that includes the first sleeve assembly 14 (i.e., the sleeve 30 and the end cap 34), and a third rotational body 84 that includes the second sleeve assembly 14, where all three of the rotational bodies 80, 82, 84 are freely rotatable relative to each other. The three rotational bodies 80, 82, 84 are fixed or limited in axial and radial movement with respect to each other in one embodiment, such as using the connection assemblies 18 described herein. The second and third rotational bodies 82, 84 are configured to support weights 11. Additionally, the second and third rotational bodies 82, 84 are connected to the first rotational body 80 such that there is no metal-on-metal contact between the first rotational body 80 and the second and third rotational bodies 82, 84. The connection assembly 18 of the barbell 10 may also include a first rotational engagement structure 86 engaging the first rotational body 80 and the second rotational body 82 and a second rotational engagement structure 86 engaging the first rotational body 80 and the third rotational body 84. The first rotational engagement structure 86 constitutes all structures and components engaging both the first rotational body 80 and the second rotational body 82, and this engagement is configured to connect the first rotational body 80 and the second rotational body 82 and to permit rotation of the second rotational body 82 with respect to the first rotational body 80. The second rotational engagement structure 86 constitutes all structures and components engaging both the first rotational body 80 and the third rotational body 84, and this engagement is configured to connect the first rotational body 80 and the third rotational body 84 and to permit rotation of the third rotational body 84 with respect to the first rotational body 80. In this configuration, the surfaces of the rotational engagement structures 86 that engage at least one of the first rotational body 80, the second rotational body 82, and/or the third rotational body 84 may be polymer surfaces formed of a polymer material as described herein. In particular, any surfaces of the rotational engagement structures 86 that moveably engage at least one of the first rotational body 80, the second rotational body 82, and/or the third rotational body 84 may be polymer surfaces formed of a polymer material as described herein.

In the embodiment of FIGS. 1-18, each of the second and third rotational bodies 82, 84 is separated from the first rotational body 80 by the respective proximal bushing 50 and distal bushing 70, which are made from a polymer material as described herein. The proximal and distal bushings 50, 70 in this embodiment permit free rotation of the rotational bodies 80, 82, 84. In this configuration, the proximal bushings 50 form proximal portions of the first and second rotational engagement structures 86, and the distal bushings 70 form distal portions of the first and second rotational engagement structures 86. The engagement of the proximal and distal bushings 50, 70 with the first, second, and third rotational bodies 80, 82, 84 also fixes the second and third rotational bodies 82, 84 against axial and radial movement with respect to the first rotational body 80. In this configuration, the metal components of the first, second, and third rotational bodies 80, 82, 84 are therefore fixed against axial and radial movement with respect to each other by polymer components (e.g., the bushings 50, 70). It is understood that components that are "fixed against" movement (such as axial or radial movement) with respect to each other as described herein may include some small clearance for slight movement. For example, as described herein, such a clearance may be at least 0.001" or 0.002".

To assemble the barbell 10 in the embodiment of FIGS. 1-18, the proximal bushings 50 are first inserted into the proximal openings 32 of the sleeves 30 and are locked into the first bore portions 41 by engagement between the engaging surfaces 57 of the proximal bushings 50 and the engagement surfaces 43 of the sleeves 30. The end portions 20, 22 of the bar 12 are inserted into the bores 31 of the sleeves 30, through the proximal bushings 50, so that the distal ends 24 of the bar 12 extend into the second bore portions 45 of the sleeves 30. The first bushing portions 71 are then inserted into the second bore portions 45 through the distal openings 33 of the sleeves 30 such that the end portions 20, 22 of the bar 12 are received through the apertures 76. The barrels 60 are then inserted into the cavities 74 of the first bushing portions 71 such that the projection 23 of each end portion 20, 22 is received through the aperture 66 of the respective barrel 60, and the fasteners 61 are connected to the projections 23. The second bushing portions 72 are then inserted into the second bore portions 45 through the distal openings 33 of the sleeves 30, and the snap rings 47 are inserted into the annular grooves 48 to lock the distal bushings 70 and the barrels 60 in place. Assembly may be simplified by inserting first bushing portion 71, the barrel 60, and the second bushing portion 72 into the second bore portions 45 and locking the components in place axially via the snap rings 47 prior to inserting the end portion 20, 22 of the bar 12 into the bore 31 of the respective sleeve 30. The fastener 61 can then be inserted through the aperture 76 of the respective second bushing portion 72 and connected to the respective projection 23. The end caps 34 are then inserted into the bores 31 through the distal opening 33 such that the cushion members 40 and abut the abutment surfaces 37, and the snap rings 39 are inserted into the annular grooves 38 to secure the end cap 34 to close the distal opening 33. Removal or disassembly of these components can be accomplished by reversing the steps discussed above. Removal of the proximal bushings 50 may be accomplished, for example, by prizing out with an appropriate tool (e.g., a flat head screwdriver), cutting and then removing, or exerting force on the distal end 56.

Figure 19:
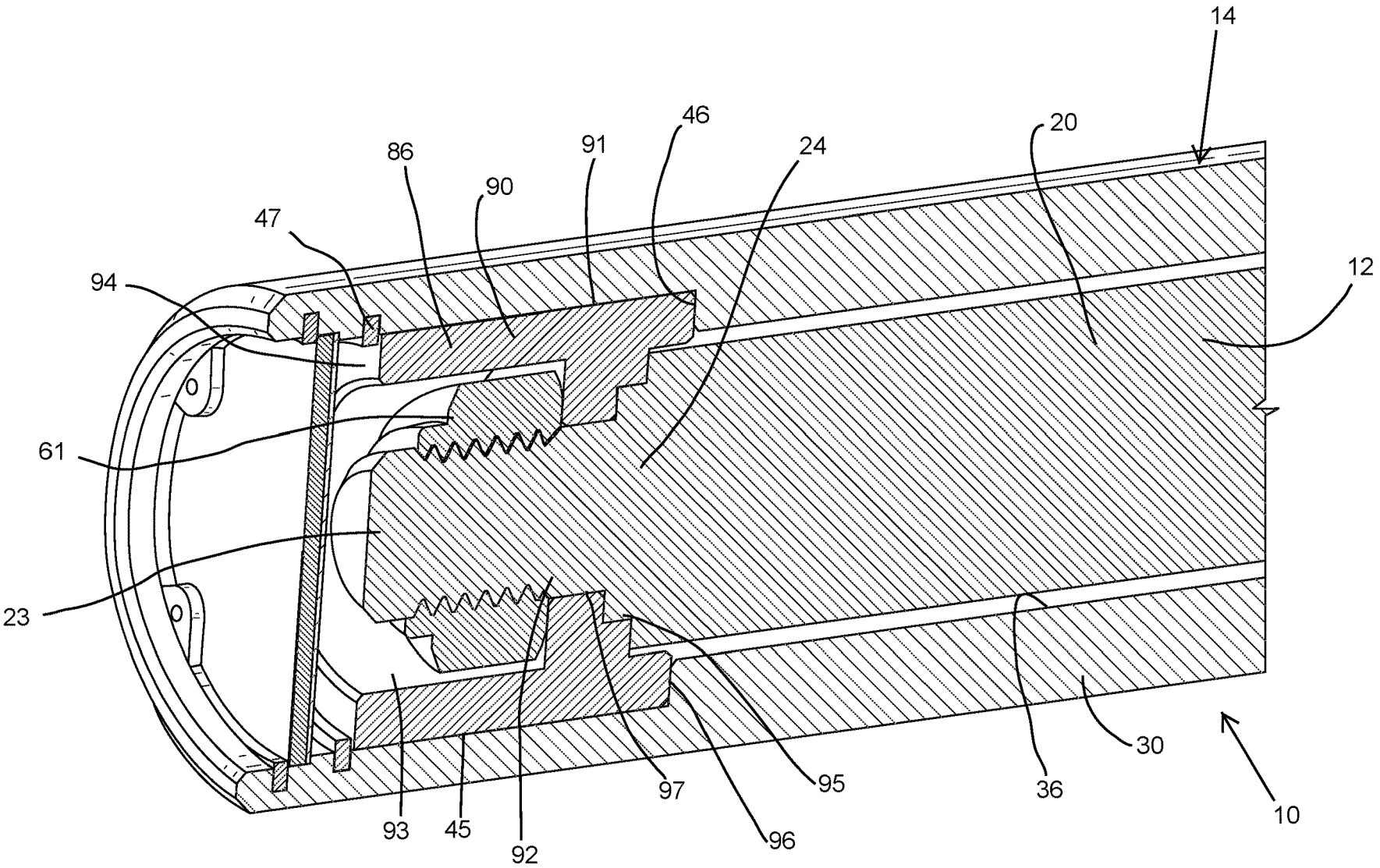
FIG. 19 is a perspective cross-section view of a portion of a first sleeve assembly of another embodiment of a barbell according to aspects of the disclosure.

FIG. 19 illustrates another embodiment of a barbell 10 according to aspects of the disclosure that includes a bar or bar member 12 having two opposed end portions 20, 22 with first and second sleeve assemblies 14, 16 positioned at the opposed end portions 20, 22 of the bar 12. The barbell 10 of FIG. 19 is similar or identical to the barbell 10 in FIGS.

Figure 20:
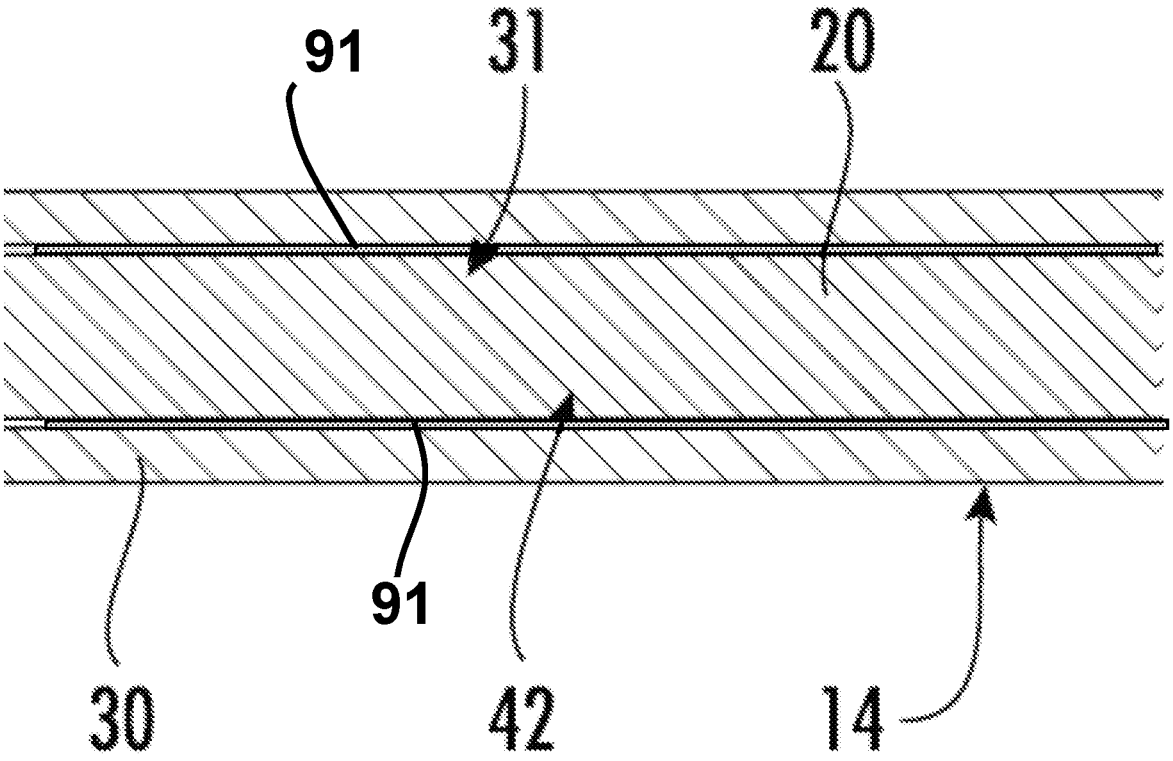
FIG. 20 is a cross-section view of a portion of a first sleeve assembly of another embodiment of a barbell according to aspects of the disclosure.

1-18, and similar reference numbers are used in FIG. 19 to reference such similar components, which may not be described again in detail for the sake of brevity. The barbell 10 of FIG. 19 differs from the barbell 10 of FIGS. 1-18 in that the barbell 10 of FIG. 19 does not include a barrel 60 and distal bushing 70. Instead, each sleeve assembly 14, 16 in FIG. 19 includes a rotor 90 fixedly connected to the distal end 24 of the bar 12 using a fastener 61 or other retaining structure. The rotor 90 has a cylindrical outer surface 91 and an axial passage 92 formed by a distal cavity 93 extending inward from the distal end 94, a proximal cavity 95 extending inward from the proximal end 96, and an aperture 97 extending between and connecting the proximal and distal cavities 95, 93. The aperture 97 is smaller in width/diameter than the distal cavity 93 and the proximal cavity 95. Additionally, the distal cavity 93 has a larger width/diameter than the proximal cavity 95 to provide room for manipulation of the fastener 61, but this structure may not be used in other embodiments. The rotor 90 is fixedly connected to the end portions 20, 22 of the bar 12 by one of the projections 23 extending axially through the aperture 97 and into the distal cavity 93, with the fastener 61 being positioned in the distal cavity 93 and connected to the projection 23. In this configuration, the abutment surface 46 and the snap ring 47 abuttingly engage the proximal and distal ends of the rotor 90 to limit axial movement of the rotor 90 with respect to the sleeve 30, thereby fixing the sleeve 30 against axial movement with respect to the bar 12. The rotor 90 is rotatable with respect to the sleeve 30 within the distal bore portion 45 to permit rotation of the sleeve 30 with respect to the bar 12. The rotor 90 in this configuration may be considered to be a distal portion of the first and/or second rotational engagement structure 86 as described herein. In one embodiment, the rotor 90 may be formed of a polymer material as described herein. For example, at least the cylindrical outer surface 91 and any other surfaces of the rotor 90 contacting metal components of the sleeve assembly 14, 16, e.g., the abutment surface 46, the snap ring 47, and the inner surface 36 of the sleeve 30, may be formed of a polymer material. In one embodiment, the portion of the rotor 90 connecting to the bar 12 may be formed of a metal material, with a polymer portion connected to the metal portion (e.g., by coating, molding, etc.), such that the polymer portion forms all surfaces that engage the sleeve 30 or other structures (e.g., the snap ring 47). In another embodiment, the entire rotor 90 may be formed of a polymer material, or at least all outer surfaces of the rotor 90 are polymer surfaces (e.g., having a metal core). The barbell 10 of FIG. 19 may include any other components and features described herein, including alternate embodiments. Assembly of the barbell 10 in FIG. 19 may be accomplished substantially as described above, but without insertion of the distal bushings, and the rotor being FIG. 20 illustrates another embodiment of a barbell 10 that is identical to the barbell 10 of FIGS. 1-18, with a sound absorbing material 91 positioned within an open space in the bore 31 of the sleeve 30. In this embodiment, the sound absorbing material 91 is positioned within the central portion 42 of the bore 31, between the bar 12 and the inner surface 36 of the sleeve 30. In this position, the sound absorbing material 91 may have a thickness that is sufficiently small to fit in the space provided and to not unduly interfere with rotation of the sleeve 30, e.g., 1/16 inch. The sound absorbing material 91 may extend over a portion of the distance, or substantially the entire distance, between the proximal and distal bushings 50, 70. In other embodiments, the sound absorbing material 91 may be additionally or alternately positioned within other open spaces within the bore 31, e.g., proximate the distal opening 33. The sound absorbing material 91 may be, for example, a rubber or neoprene material, a foam material, a batting material, or other materials that serve to damp and/or absorb sound. In various embodiments, the sound absorbing material 91 may be connected to either the sleeve 30 or the bar 12 (or another structure), or may be loose within the open space. In one embodiment, the sound absorbing material 91 may only contact one of the bar 12 or the sleeve 30, in order to reduce friction.

Various embodiments of barbells and components thereof have been described herein, which include various components and features. In other embodiments, the barbell may be provided with any combination of such components and features. It is also understood that in other embodiments, the various devices, components, and features of the barbell described herein may be constructed with similar structural and functional elements having different configurations, including different ornamental appearances.

The barbells and components thereof described herein provide benefits and advantages over existing barbells. For example, the barbells 10 shown in FIGS. 1-19 exhibit significantly smaller noise emission and vibration when dropped from an elevated position onto a variety of different surfaces, as compared to existing barbells. For example, the barbell 10 shown in FIGS. 1-18 has exhibited at least a 10 dB reduction in sound volume as compared to existing barbells that include metal-on-metal contact between rotational bodies, when dropped from a fixed, consistent height with equal loading. When combined with the frequency of sound emission from dropping a loaded barbell from an elevated position, the barbell 10 of FIGS. 1-18 creates a perception of a 50% reduction in noise. It is contemplated that the barbell 10 in FIG. 19 may produce similar performance. It is also contemplated that this vastly improved performance is due to the use of polymeric bushings and/or polymer surfaces, and the resultant lack of metal-on-metal contact. This benefit is particularly advantageous in smaller gyms located in residential areas, where the sound of dropping weights throughout the day may disturb residents. Additionally, the barbell structures described herein provide good durability and product life, and bushings or other components can be easily replaced if they are damaged. Further, the low friction surfaces provided by the bushings allow free rotation of the sleeve assemblies (and any weights mounted thereon) with respect to the bar, providing superior performance. It is contemplated that the use of low friction polymer structures (i.e., the bushing portions 71, 72 of the distal bushing) to axially locate the sleeves with respect to the bar reduce friction and resistance against rotation of the sleeves with respect to the bar. Still further, the construction of the barbell permits the bushings 50, 70 to be removed, interchanged, or replaced easily and quickly with simple tools, providing a consumer the ability to perform these actions at home. The consumer would also be able to interchange bushings with other bushings made of other materials with different properties (e.g., hardness, noise/vibration damping, lubricity, friction, color/design, etc.) as desired by the consumer to "tune" or customize performance or appearance of the barbell, such as spin, noise/vibration damping, appearance, etc. The use of a sound absorbing material 91 as described herein may further reduce the noise produced when the barbell 10 is dropped. Still other benefits and advantages are recognized by those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. When used in description of a method or process, the term "providing" (or variations thereof) as used herein means generally making an article available for further actions, and does not imply that the entity "providing" the article manufactured, assembled, or otherwise produced the article. Nothing in this specification should be construed as requiring a specific three dimensional orientation of structures in order to fall within the scope of this invention, unless explicitly specified by the claims. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A barbell comprising:

a bar having a first end portion and a second end portion;

a first sleeve assembly comprising a first sleeve having a first proximal end, a first distal end, and a first axial bore extending between the first proximal and distal ends, the first axial bore having a first distal bore portion proximate the first distal end, wherein the first end portion of the bar is received through the first axial bore and extends to the first distal bore portion;

a first distal bushing received in the first distal bore portion of the first sleeve and fixed against axial movement with respect to the first sleeve assembly, the first distal bushing having a first cavity and having a first flange extending inward at a proximal end of the first distal bushing and a second flange extending inward at a distal end of the first distal bushing; and a first barrel fixed to the first end portion of the bar, the first barrel received within the first cavity of the first distal bushing, wherein the first distal bushing has a first outer surface engaging the first sleeve and a first inner surface engaging the first barrel within the first cavity, wherein the first and second flanges engage proximal and distal ends of the first barrel, wherein the first distal bushing permits the first sleeve assembly to be freely rotatable around the bar and the first barrel, and wherein at least one of the first outer surface and the first inner surface are polymer surfaces.

2. The barbell of claim 1, wherein the first barrel fixed to the first end portion of the bar by a threaded connection.

3. The barbell of claim 2, wherein the bar further comprises a first threaded projection extending outward from the first end portion, and the first barrel is fixed to the first end portion of the bar by a first fastener threaded onto the first threaded projection.

4. The barbell of claim 1, wherein the first barrel is integrally formed with the bar to fix the first barrel to the first end portion of the bar.

5. The barbell of claim 1, wherein the first barrel is fixed against axial movement with respect to the first distal bushing by engagement with the first and second flanges, and the first barrel is also fixed against axial movement with respect to the bar, such that the bar is thereby also fixed against axial movement with respect to the first distal bushing.

6. The barbell of claim 1, wherein the first distal bushing comprises a first bushing portion and a second bushing portion in abutting contact with each other, the first bushing portion having a first cylindrical wall with the first flange being a first annular flange extending inward from the first cylindrical wall to define a first aperture at the proximal end of the first distal bushing, and wherein the second bushing portion is positioned at the distal end of the first distal bushing, the second bushing portion having a second cylindrical wall with the second flange being a second annular flange extending inward from the second cylindrical wall to define a second aperture at the distal end of the first distal bushing, and wherein the first cylindrical wall of the first bushing portion and the second cylindrical wall of the second bushing portion combine to define the first outer surface and the first inner surface, and to further define the first cavity as a cylindrical cavity.

7. The barbell of claim 1, wherein the first outer surface and the first inner surface are formed of a same polymer material.

8. The barbell of claim 1, wherein the first sleeve has a first abutment surface in the first distal bore portion engaging the proximal end of the first distal bushing, and the barbell further comprises a first retaining member engaging the first sleeve and the distal end of the first distal bushing, such that the first distal bushing engaging the first abutment surface and the first retaining member fixes the first distal bushing against axial movement with respect to the first sleeve assembly.

9. The barbell of claim 1, further comprising a retaining member engaging the distal end of the first distal bushing to retain the first distal bushing in the first distal bore portion.

10. The barbell of claim 1, wherein the polymer surfaces are all formed of polymer materials having a durometer hardness of 50 Shore A to 100 Shore A.

11. A barbell comprising:

a bar having a first end portion and a second end portion;

a first sleeve assembly comprising a first sleeve having a first proximal end, a first distal end, and a first axial bore extending between the first proximal and distal ends, the first axial bore having a first distal bore portion proximate the first distal end, wherein the first end portion of the bar is received through the first axial bore and extends to the first distal bore portion;

a first distal bushing received in the first distal bore portion of the first sleeve and fixed against axial movement with respect to the first sleeve assembly, the first distal bushing having a first cavity;

a first barrel fixed to the first end portion of the bar, the first barrel having a larger diameter than the bar and being received within the first cavity of the first distal bushing, wherein the first distal bushing has a first outer surface engaging the first sleeve and a first inner surface engaging the first barrel within the first cavity, wherein the first distal bushing permits the first sleeve assembly to be freely rotatable around the bar and the first barrel, and wherein at least one of the first outer surface and the first inner surface are polymer surfaces.

12. The barbell of claim 11, wherein the first distal bushing comprises a first bushing portion and a second bushing portion in abutting contact with each other, the first bushing portion having a first cylindrical wall with a first annular flange extending inward from the first cylindrical wall to define a first aperture at a proximal end of the first distal bushing, and wherein the second bushing portion is positioned at a distal end of the first distal bushing, and the first and second bushing portions combine to define the first cavity of the first distal bushing.

13. The barbell of claim 12, wherein the second bushing portion has a second cylindrical wall with a second annular flange extending inward from the second cylindrical wall to define a second aperture at the distal end of the first distal bushing, and wherein the first cylindrical wall of the first bushing portion and the second cylindrical wall of the second bushing portion combine to define the first outer surface and the first inner surface, and to further define the first cavity as a cylindrical cavity.

14. The barbell of claim 13, wherein the second bushing portion is identical to the first bushing portion and is positioned in reverse orientation relative to the first bushing portion.

15. The barbell of claim 11, wherein the first barrel fixed to the first end portion of the bar by a threaded connection.

16. The barbell of claim 15, wherein the bar further comprises a first threaded projection extending outward from the first end portion, and the first barrel is fixed to the first end portion of the bar by a first fastener threaded onto the first threaded projection.

17. The barbell of claim 11, wherein the first barrel is integrally formed with the bar to fix the first barrel to the first end portion of the bar.

18. The barbell of claim 11, wherein the first distal bushing has a first flange and a second flange extending inward, with the first cavity defined between the first and second flanges, and the first barrel is fixed against axial movement with respect to the first distal bushing by engagement with the first and second flanges, and wherein the first barrel is also fixed against axial movement with respect to the bar, such that the bar is thereby also fixed against axial movement with respect to the first distal bushing.

19. The barbell of claim 11, wherein the first outer surface and the first inner surface are formed of a same polymer material.

20. The barbell of claim 11, wherein the first sleeve has a first abutment surface in the first distal bore portion engaging a proximal end of the first distal bushing, and the barbell further comprises a first retaining member engaging the first sleeve and a distal end of the first distal bushing, such that the first distal bushing engaging the first abutment surface and the first retaining member fixes the first distal bushing against axial movement with respect to the first sleeve assembly.

21. The barbell of claim 11, further comprising a retaining member engaging a distal end of the first distal bushing to retain the first distal bushing in the first distal bore portion.

22. The barbell of claim 11, wherein the polymer surfaces are all formed of polymer materials having a durometer hardness of 50 Shore A to 100 Shore A.

23. A barbell comprising:

a bar having a first end portion and a second end portion, with a first threaded projection extending outward from the first end portion and a second threaded projection extending outward from the second end portion;

a first sleeve assembly comprising a first sleeve having a first proximal end, a first distal end, and a first axial bore extending between the first proximal and distal ends, the first axial bore having a first distal bore portion proximate the first distal end, wherein the first end portion of the bar is received through the first axial bore and extends to the first distal bore portion;

a first distal bushing received in the first distal bore portion of the first sleeve and fixed against axial movement with respect to the first sleeve assembly, the first distal bushing having a first cavity and a first aperture extending to the first cavity and receiving the first end portion of the bar therethrough;

a first barrel received within the first cavity of the first distal bushing, the first barrel fixed to the first end portion of the bar by the first threaded projection extending through a first barrel aperture of the first barrel, with a first fastener threaded onto the first threaded projection, and the first barrel being fixed against axial movement with respect to the first distal bushing and being fixed against axial and rotational movement with respect to the bar, wherein the first distal bushing permits the first sleeve assembly to be freely rotatable around the bar and the first barrel, and wherein at least one of a first outer surface and a first inner surface of the first distal bushing are polymer surfaces.

24. The barbell of claim 23, wherein the first distal bushing has a first flange and a second flange extending inward, with the first cavity defined between the first and second flanges, and wherein the first barrel is fixed against axial movement with respect to the first distal bushing by engagement with the first and second flanges, and the first barrel is also fixed against axial movement with respect to the bar, such that the bar is thereby also fixed against axial movement with respect to the first distal bushing.

25. The barbell of claim 24, wherein the first distal bushing comprises a first bushing portion and a second bushing portion in abutting contact with each other, the first bushing portion having a first cylindrical wall with the first flange being a first annular flange extending inward from the first cylindrical wall to define the first aperture at a proximal end of the first distal bushing, and wherein the second bushing portion is positioned at a distal end of the first distal bushing, the second bushing portion having a second cylindrical wall with the second flange being a second annular flange extending inward from the second cylindrical wall to define a second aperture at the distal end of the first distal bushing, and wherein the first cylindrical wall of the first bushing portion and the second cylindrical wall of the second bushing portion combine to define the first outer surface and the first inner surface, and to further define the first cavity as a cylindrical cavity.

* * * * *